US006523930B2

(12) United States Patent
Griffin et al.

(10) Patent No.: US 6,523,930 B2
(45) **Date of Patent: *Feb. 25, 2003**

(54) INK JET PRINTER WITH CLEANING MECHANISM USING LAMINATED POLYIMIDE STRUCTURE AND METHOD CLEANING AN INK JET PRINTER

(75) Inventors: Todd R. Griffin, Rochester, NY (US); Ravi Sharma, Fairport, NY (US); John R. Debesis, Penfield, NY (US); Robert J. Green, Jr., Macedon, NY (US); Larry L. Lapa, Rochester, NY (US); Edwin A. Mycek, Scottsville, NY (US)

(73) Assignee: Eastman Kodak Company, Rochester, NY (US)

( * ) Notice: Subject to any disclaimer, the term of this patent is extended or adjusted under 35 U.S.C. 154(b) by 39 days.

This patent is subject to a terminal disclaimer.

(21) Appl. No.: 09/750,809

(22) Filed: Dec. 28, 2000

(65) Prior Publication Data

US 2002/0085058 A1 Jul. 4, 2002

(51) Int. Cl.[7] ..... B41J 2/165
(52) U.S. Cl. ..... 347/28; 347/29; 347/33
(58) Field of Search ..... 347/28, 33, 24, 347/22, 29, 32, 34, 93

(56) References Cited

U.S. PATENT DOCUMENTS 5,574,485 A * 11/1996 Anderson et al. ..... 347/27
5,614,930 A 3/1997 Osborne et al. ..... 347/33
5,760,802 A * 6/1998 Ebinuma et al. ..... 347/33
6,158,838 A * 12/2000 Capurso ..... 347/28
6,164,751 A 12/2000 Griffin et al. ..... 347/28
6,241,337 B1 6/2001 Sharma et al. ..... 347/28
6,347,858 B1 2/2002 Faisst, Jr. et al. ..... 347/22

OTHER PUBLICATIONS

U.S. patent application Ser. No. 09/195,727, filed Nov. 18, 1998, entitled "An Ink Jet Printer with Cleaning Mechanism and Method of Assembling Same" by Charles Faisst, Jr. et al.

* cited by examiner

*Primary Examiner*—Shih-wen Hsieh
(74) *Attorney, Agent, or Firm*—Norman Rushefsky

(57) ABSTRACT

A self-cleaning ink jet printer with cleaning mechanism and method of cleaning the ink jet printer. The printer comprises a print head having a surface thereon surrounding a plurality of ink ejection orifices. The orifices are in communication with respective ones of a plurality of ink channels formed in the print head. A solvent delivering canopy is constructed from alternating stacked layers of polyimide and stainless steel sheets with internal geometries, one on top of each other, thus creating internal fluidic passageways. The canopy is connected to a manifold body and has a passageway alignable with the surface. Contaminant residing on the surface is entrained in the solvent when a wiper blade loosens contaminant from the surface. Per an applied vacuum, the canopy vacuums the solvent and entrained contaminant from the surface.

45 Claims, 16 Drawing Sheets

INK JET PRINTER WITH CLEANING MECHANISM USING LAMINATED POLYIMIDE STRUCTURE AND METHOD CLEANING AN INK JET PRINTER

BACKGROUND OF THE INVENTION

This invention generally relates to ink jet printer apparatus and methods and more particularly relates to an ink jet printer with cleaning mechanism, and method of assembling same.

An ink jet printer produces images on a receiver by ejecting ink droplets onto the receiver in an imagewise fashion. The advantages of non-impact, low-noise, low energy use, and low cost operation in addition to the capability of the printer to print on plain paper are largely responsible for the wide acceptance of ink jet printers in the marketplace.

In this regard, "continuous" ink jet printers utilize electrostatic charging tunnels placed close to the point where ink droplets are being ejected in the form of a stream. Selected ones of the droplets are electrically charged by the charging tunnels. The charged droplets are deflected downstream by the presence of deflector plates that have a predetermined electric potential difference between them. A gutter may be used to intercept the charged droplets, while the uncharged droplets are free to strike the recording medium.

In the case of "on-demand" ink jet printers, at every orifice a pressurization actuator is used to produce the ink jet droplet. In this regard, either one of two types of actuators may be used. These two types of actuators are heat actuators and piezoelectric actuators. With respect to heat actuators, a heater placed at a convenient location heats the ink and a quantity of the ink will phase change into a gaseous steam bubble and raise the internal ink pressure sufficiently for an ink droplet to be expelled to the recording medium. With respect to piezoelectric actuators, a piezoelectric material is used possess piezoelectric properties such that an electric field is produced when a mechanical stress is applied. The converse also holds true, that is, an applied electric field will produce a mechanical stress in the material. Some naturally occurring materials possessing this characteristics are quartz and tourmaline. The most commonly produced piezoelectric ceramics are lead zirconate titanate, lead metaniobate, lead titanate, and barium titanate.

Inks for high speed ink jet printers, whether of the "continuous" or "piezoelectric" type, have a number of special characteristics. For example, the ink should incorporate a nondrying characteristic, so that drying of ink in the ink ejection chamber is hindered or slowed to such a state that by occasional spitting of ink droplets, the cavities and corresponding orifices are kept open. The addition of glycol facilitates free flow of ink through the ink jet chamber.

Of course, the ink jet print head is exposed to the environment where the ink jet printing occurs. Thus, the previously mentioned orifices are exposed to many kinds of air born particulates. Particulate debris may accumulate on surfaces formed around the orifices and may accumulate in the orifices and chambers themselves. That is, the ink may combine with such particulate debris to form an interference burr that blocks the orifice or that alters surface wetting to inhibit proper formation of the ink droplet. Also, the ink may simply dry-out and form hardened deposits on the print head surface and in the ink channels. The particulate debris and deposits should be cleaned from the surface and orifice to restore proper droplet formation. In the prior art, this cleaning is commonly accomplished by brushing, wiping, spraying, vacuum suction or spitting of ink through the orifice.

Thus, inks used in ink jet printers can be said to contribute to the following problems: the inks tend to dry-out in and around the orifices resulting in clogging of the orifices; the wiping of the orifice plate causes wear on the plate and wiper; the wiper itself produces particles that clog the orifice, cleaning cycles are time consuming and slow productivity of ink jet printers. Moreover, printing rate declines in large format printing where frequent cleaning cycles interrupt the printing of an image. Printing rate also declines in the case when a special printing pattern is initiated to compensate for clogged or badly performing orifices.

Ink jet print head cleaners are well known. For example, a wiping system for ink jet print heads is disclosed in U.S. Pat. No. 5,614,930 titled "Orthogonal Rotary Wiping System For Inkjet Printheads" issued Mar. 25, 1997 in the name of William S. Osbome et al. This patent discloses a rotary service station that has a wiper-supporting tumbler. The tumbler rotates to wipe the print head along a length of linearly aligned nozzle. In addition, a wiper scraping system scrapes the wipers to clean them. However, Osborne et al. do not disclose use of an external solvent to assist cleaning and also does not disclose complete removal of the external solvent. U.S. patent application Ser. No. 09/195,727 entitled "Ink Jet Printer With Cleaning Mechanism and Method of Assembling Same" by Charles Faisst, Jr. et al and now U.S. Pat. No. 6,347,858 discloses the use of external solvents to assist in cleaning. The Faisst application, however, requires separate canopies for the solvent delivery and solvent removal processes which complicates the cleaning apparatus and increases costs. In addition, the method of assembly disclosed in the Faisst application is somewhat undesirable in terms of size, cost and complexity.

Therefore, there is a need to provide a suitable ink jet printer with a cheaper, more compact cleaning mechanism, having a simplistic method of assembly, that is capable of cleaning the print head surface.

SUMMARY OF THE INVENTION

As such, an object of the present invention is to provide an ink jet printer with cleaning mechanism and method of assembling same, which cleans the surface of a print head belonging to the printer.

Accordingly, the present invention provides an ink jet printer comprising a print head having a surface thereon and an ink channel therein and a cleaning mechanism associated with the print head and adapted to-clean contaminant from the surface.

According to an exemplary embodiment of the invention, an ink jet printer comprises a print head having a surface thereon surrounding a plurality of ink ejection orifices. The orifices are in communication with respective ones of a plurality of ink channels formed in the print head. A cleaning block assembly is comprised of a manifold body with attached canopy and wiper blade edge. The canopy has a plurality of passageways formed therein, with first and second passageways alignable to the printhead surface. The first passageway delivers a liquid solvent cleaning agent to the surface in the approximate location where the wiper blade is in contact with the printhead surface. As the wiper blade traverses the surface contaminant is loosened from the surface and becomes entrained in the solvent. The second passageway, also alignable to the printhead surface, removes the solvent with entrained contaminant from the surface via an applied vacuum. A piping circuit is provided for supplying liquid cleaning solution filtering the particulate matter from the solvent and for re-circulating clean solvent to the surface of the print head.

A translation mechanism is connected to the manifold body for translating the cleaning block across the print head surface. In this regard, the translation mechanism may comprise a lead-screw engaging the manifold body.

An advantage of the present invention is that solvent supply and removal are accomplished simultaneously through a single, simplistic canopy structure.

These and other objects, features and advantages of the present invention will become apparent to those skilled in the art upon a reading of the following detailed description when taken in conjunction with the drawings wherein therein are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
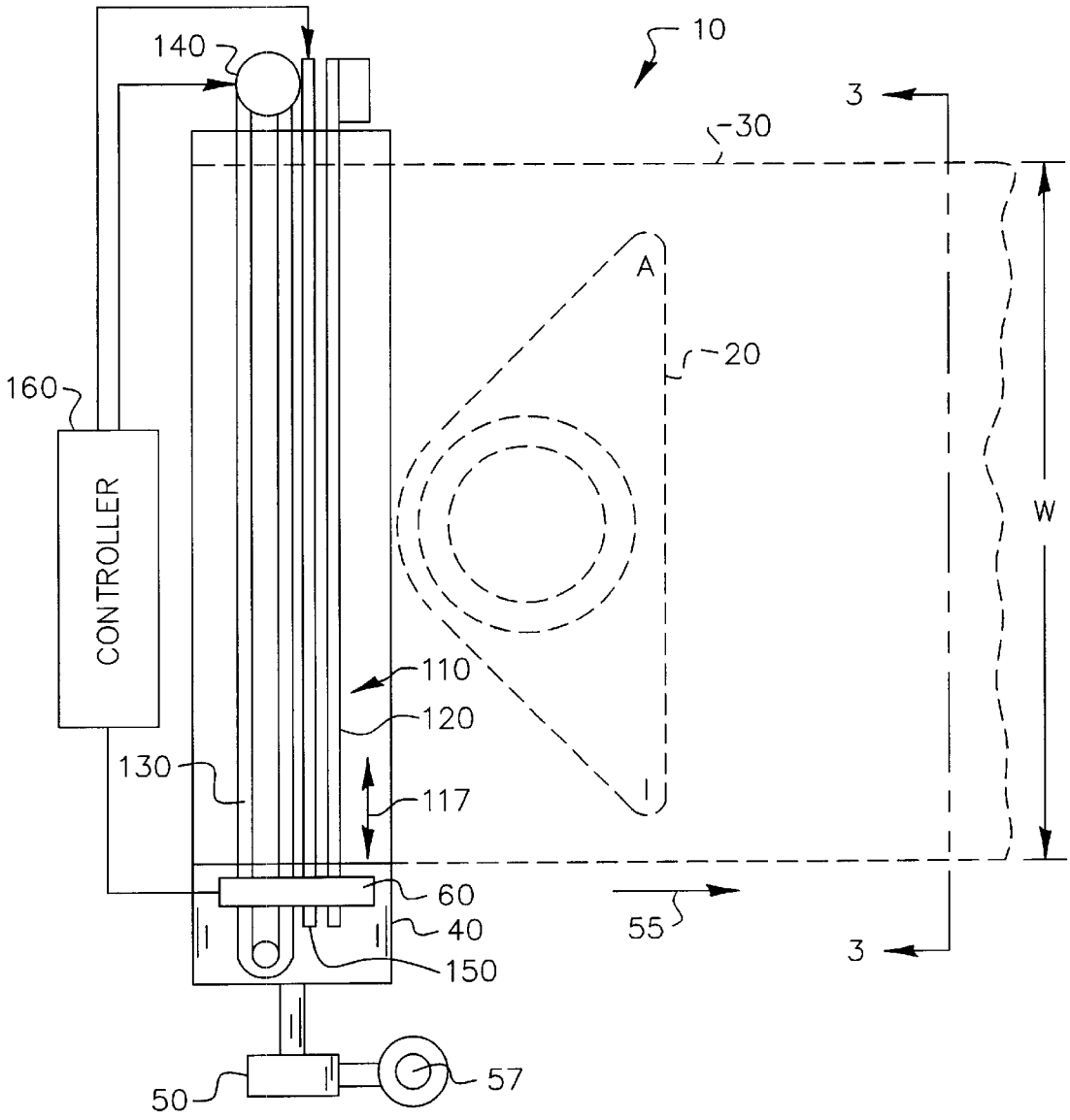
FIG. 1 is a view in plan of a first embodiment ink jet printer, the printer having a reciprocating print head and a pivotable platen roller disposed adjacent the print head.
Figure 2:
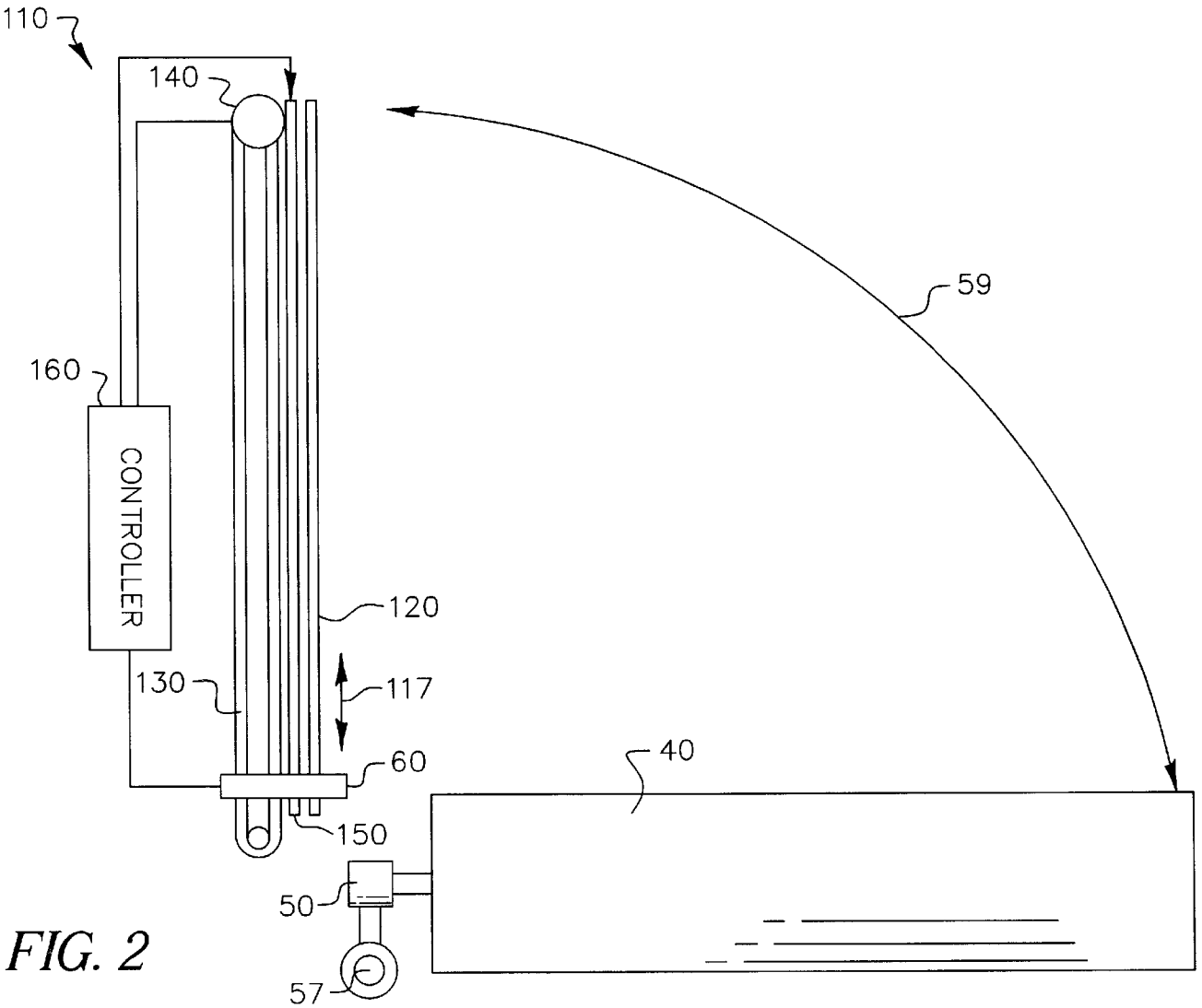
FIG. 2 is a view in plan of the first embodiment of the printer showing the pivotable platen roller pivoting in an arc outwardly from the print head.

Referring to FIGS. 1 and 2, therein is shown a first embodiment ink jet printer, denoted generally as 10, for printing an image 20 (shown in phantom) on a receiver 30 (also shown in phantom), which may be a reflective-type receiver (e.g., paper) or a transmissive-type receiver (e.g., transparency). Receiver 30 is supported on a platen roller 40 capable of being rotated by a platen roller motor 50 engaging platen roller 40. Thus, when platen roller motor 50 rotates platen roller 40, receiver 30 will advance in a direction illustrated by a first arrow 55. Platen roller 40 is adapted to pivot outwardly about a pivot shaft 57 along an arc 59 for reasons disclosed herein below. Many designs for feeding paper for printing are possible. For example, another mechanism utilizes a first set of feed rollers to dispose receiver onto a plate for printing while a second set of feed rollers remove the receiver when printing is completed.

Figure 3:
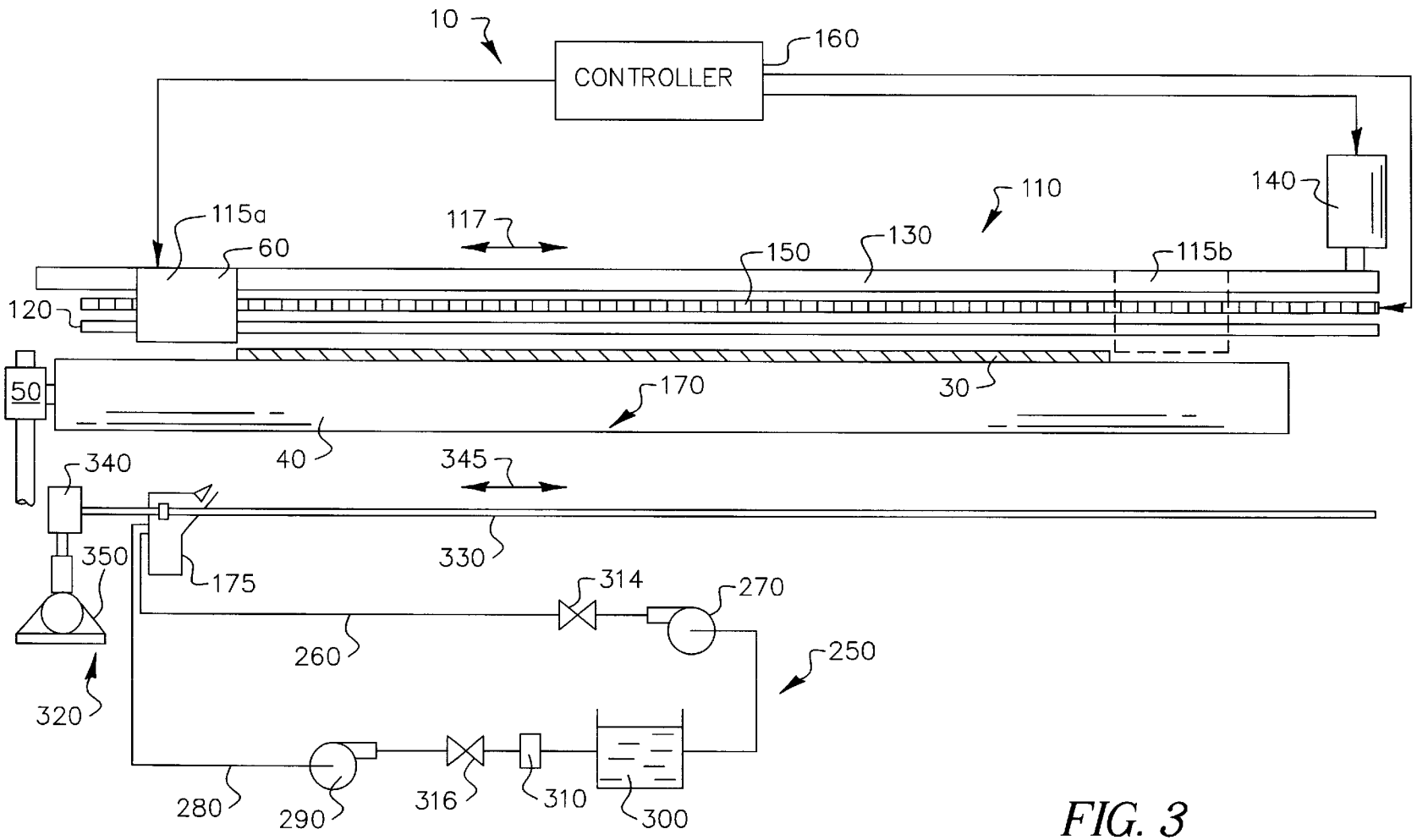
FIG. 3 is a view taken along section line 3—3 of FIG. 1, this view showing a cleaning mechanism poised to move to a position adjacent the print head to clean the print head.
Figure 4:
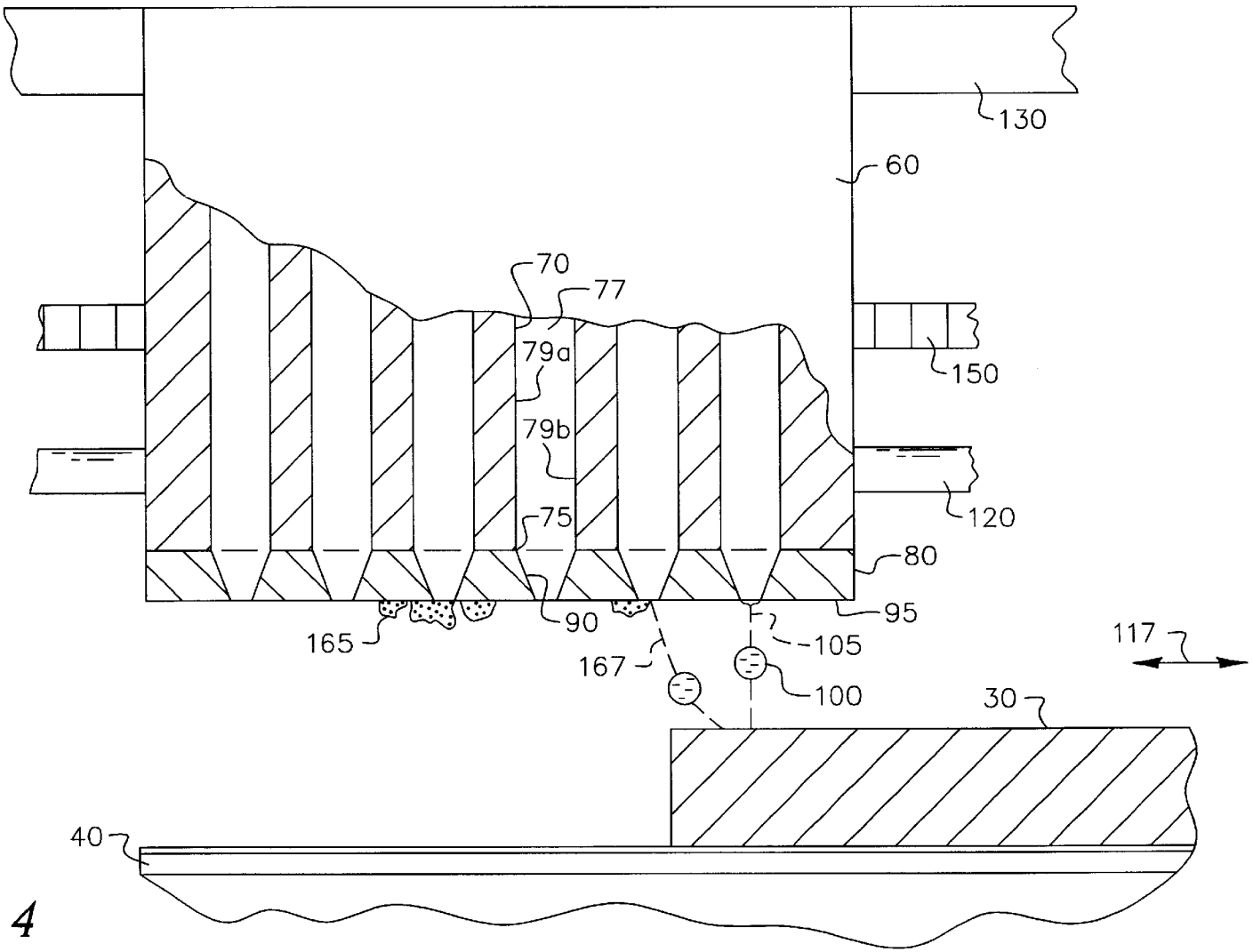
FIG. 4 is a view in partial elevation of the print head and adjacent platen roller.
Figure 5:
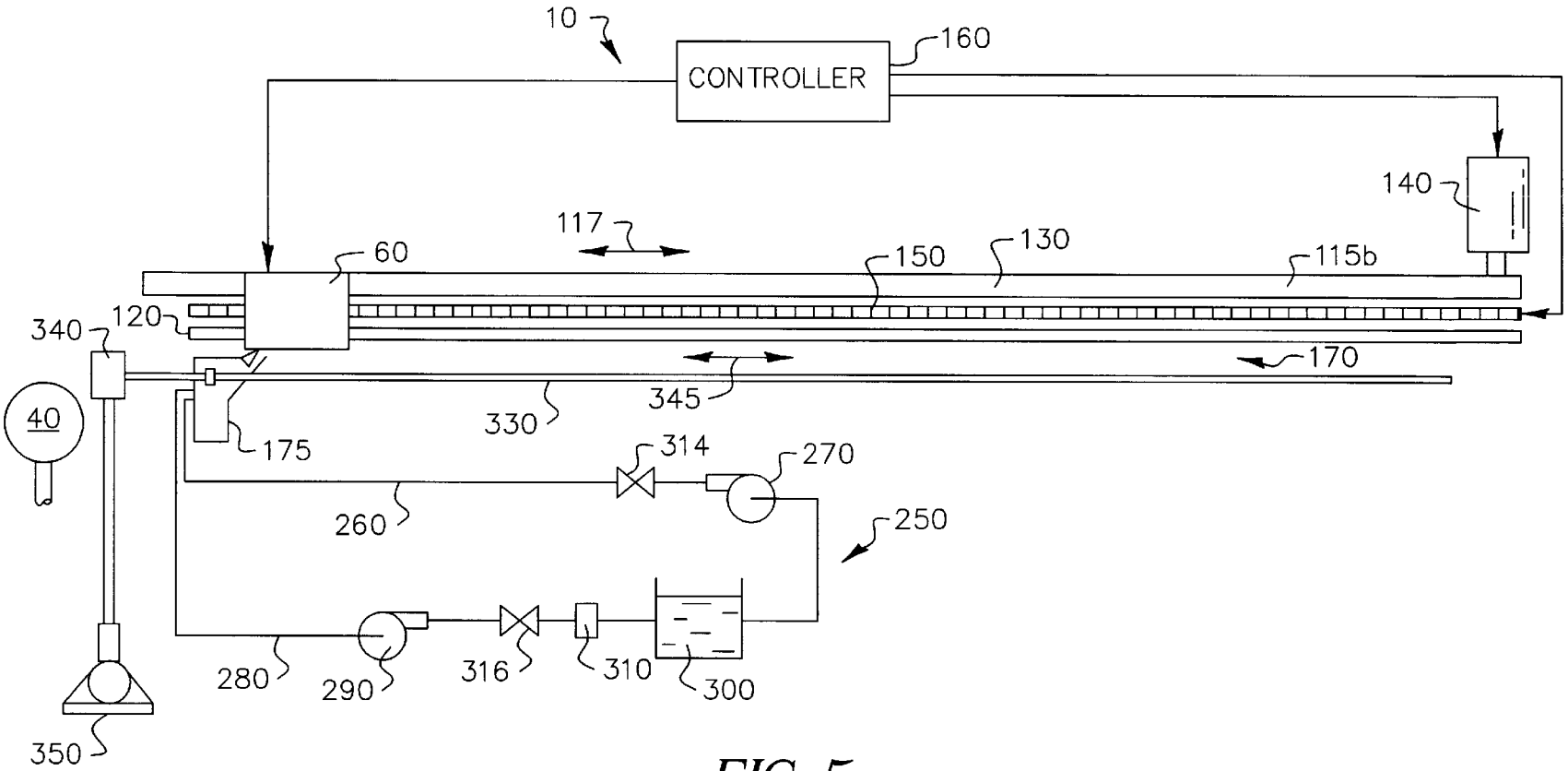
FIG. 5 is a view in elevation of the first embodiment printer, this view showing the cleaning mechanism having been moved into position to clean the print head.
Figure 6:
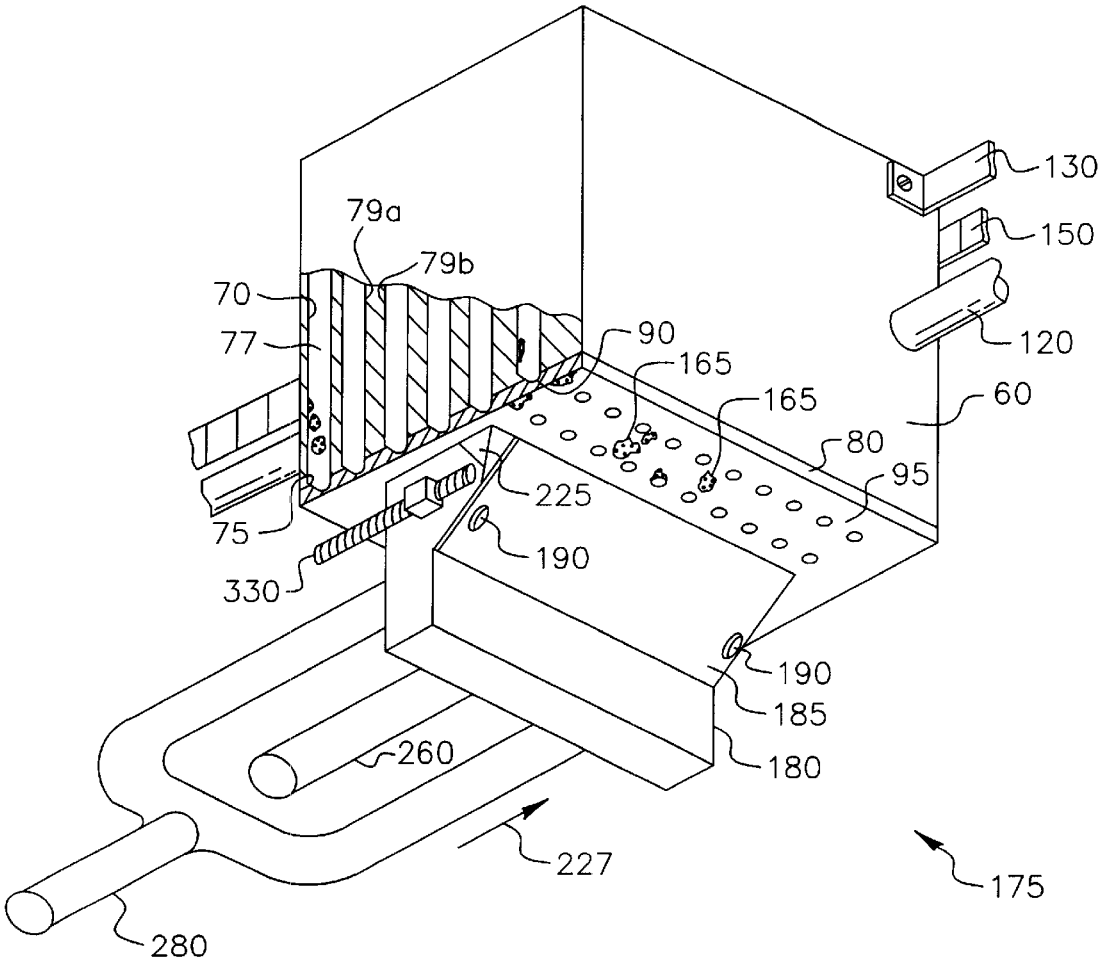
FIG. 6 is a view in perspective of a first embodiment cleaning block belonging to the cleaning mechanism, the first embodiment cleaning block here shown cleaning the print head.

Referring to FIGS. 1, 3 and 4, printer 10 also comprises a reciprocating print head 60 disposed adjacent to platen roller 40. Print head 60 includes a plurality of ink channels 70 formed therein (only six of which are shown), each channel 70 terminating in a channel outlet 75. In addition, each channel 70, which is adapted to hold an ink body 77 therein, is defined by a pair of oppositely disposed parallel side walls 79*a* and 79*b*. Print head 60 may further include a cover plate 80 having a plurality of orifices 90 formed therethrough and co-linearly aligned with respective ones of channel outlets 75, such that each orifice 90 faces receiver 30. A surface 95 of cover plate 80 surrounds all orifices 90 and also faces receiver 30.

In operation, an image 20 is printed on receiver 30 when an ink droplet 100 is released from ink channel 70 through orifice 90 in direction of receiver 30 along a preferred axis 105 normal to surface 95, so that droplet 100 is suitably intercepted by receiver 30. To achieve this result, print head 60 may be a "piezoelectric inkjet" print head formed of a piezoelectric material, such as lead zirconium titanate (PZT). Such a piezoelectric material is mechanically responsive to electrical stimuli so that side walls 79*a*, 79*b* simultaneously inwardly deform when electrically stimulated. When side walls 79*a*, 79*b* simultaneously inwardly deform, a certain volume of channel 70 decreases to squeeze ink droplets 100 from channel 70 and through orifice 90.

Referring again to FIGS. 1, 3 and 4, a transport mechanism, denoted generally as 110, is connected to print head 60 for reciprocating print head 60 between a first position 115*a* thereof and a second position 115*b* (shown in phantom). In this regard, transport mechanism 110 reciprocates print head 60 in the direction of a second arrow 117. Print head 60 slidably engages an elongate guide rail 120, which guides print head 60 parallel to platen roller 40 while print head 60 is reciprocated. Transport mechanism 10 also comprises a drive belt 130 attached to print head 60 for reciprocating print head 60 between first position 115*a* and second position 115*b*, as described presently. In this regard, a reversible drive belt motor 140 engages belt 130, such that belt 130 reciprocates in order that print head 60 reciprocates with respect to platen 40. Moreover, an encoder strip 150 coupled to print head 60 monitors position of print head 60 as print head 60 reciprocates between first position 115*a* and second position 115*b*. In addition, a controller 160 is connected to platen roller motor 50, drive belt motor 140, encoder strip 150 and print head 60 for controlling operation thereof to suitably form image 20 on receiver 30. Such a controller may be a Model CompuMotor controller available from Parker Hannifin, Incorporated located in Rohnert Park, Calif.

As best seen in FIG. 4, it has been observed that surface 95 may have contaminant thereon, such as particulate matter 165. Such particulate matter 165 also may partially or completely obstruct orifice 90. Particulate matter 165 may be, for example, particles of dirt, dust, metal and/or encrustations of dried ink. The contaminant may also be an unwanted film (e.g., grease, oxide, or the like). Although the description herein refers to particulate matter, it is to be understood that the invention pertains to such unwanted film, as well. Presence of particulate matter 165 is undesirable because when particulate matter 165 completely obstructs orifice 90, ink droplet 100 is prevented from being ejected from orifice 90. Also, when particulate matter 165 partially obstructs orifice 90, flight of ink droplet 105 may be diverted from preferred axis 105 to travel along a non-preferred axis 167 (as shown). If ink droplet 100 travels along non-preferred axis 167, ink droplet 100 will land on receiver 30 in an unintended location. In this manner, such complete or partial obstruction of orifice 90 leads to printing artifacts such as "banding", a highly undesirable result. Also, presence of particulate matter 165 on surface 95 may alter surface wetting and inhibit proper formation of droplet 100. Therefore, it is desirable to clean (i.e., remove) particulate matter 165 to avoid printing artifacts and improper formation of droplet 100.

Figure 7:
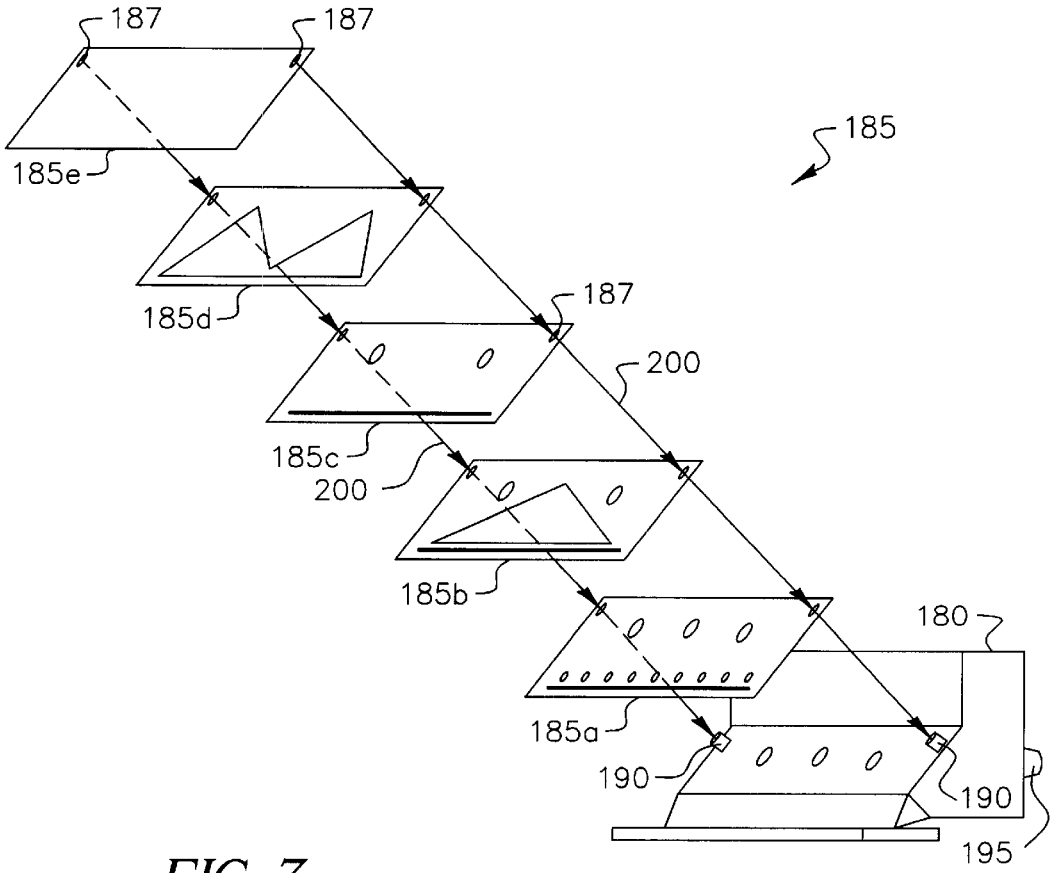
FIG. 7 is an exploded view showing the assembly of the canopy and its attachment to the cleaning block.
Figure 8:
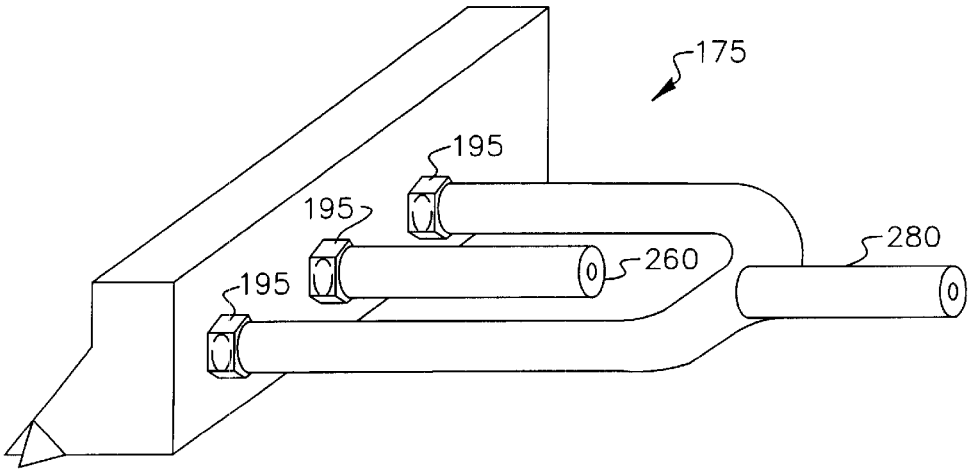
FIG. 8 is a rear perspective view of the cleaning block showing the fluidic connections.
Figure 9:
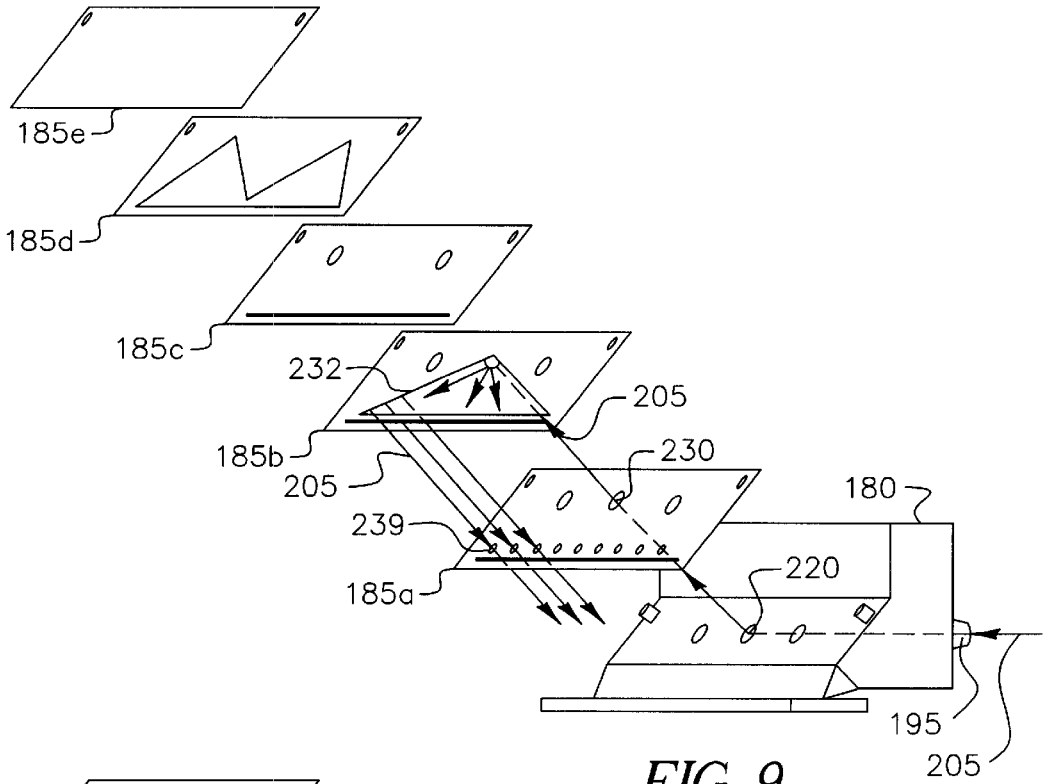
FIG. 9 is an exploded view of the canopy assembly illustrating the cleaning solvent flow delivery path through the canopy.
Figure 10:
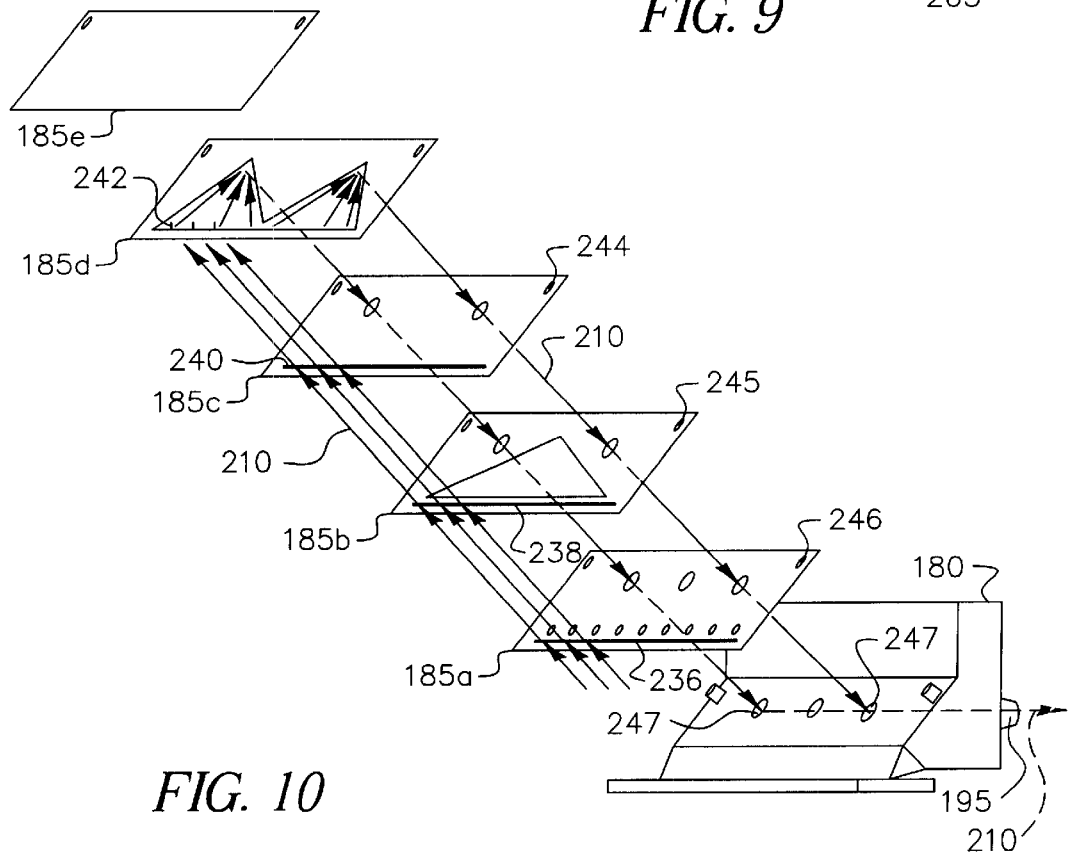
FIG. 10 is an exploded view of the canopy assembly illustrating the cleaning solvent removal path through the canopy.

Referring to FIGS. 7, 9, and 10, canopy 185 is comprised of multiple canopy layers, namely first canopy layer 185*a*, second canopy layer 185*b*, third canopy layer 185*c*, fourth canopy layer 185*d*, and fifth canopy layer 185*e*. Preferably, first canopy layer 185*a*, third canopy layer 185*c*, and fifth canopy layer 185*e* are made of a thin polyimide sheet such as that available from Dupont. The geometries shown in FIGS. 7, 9, and 10 are formed in the polyimide material through a process of photolithography, but are not limited in scope to this process and can be made via other processes known in the art such as plasma etching. The polyimide sheets used in canopy 185 are from 0.001" to 0.010" thick, but are not limited to these thicknesses.

Preferably, second canopy layer 185*b*, and fourth canopy layer 185*d* are made of stainless steel and range from 0.001" to 0.010" thick, but are also not limited to these thicknesses. These interchanged stainless layers 185*b*, 185*d* are used to increase the rigidity of the canopy 185. The geometries in the stainless steel sheets are also formed through the process of photolithography, but are not limited in scope to this process, and can be made via other processes known in the art such as plasma etching.

In use the canopy 185 is assembled to manifold body 180, with each of the aforementioned sheets stacked one on top of each other and aligned per alignment holes 187 on each of the sheets and alignment pins 190 on manifold body 180. To facilitate assembly, the front and backside of the polyimide has a tacky surface, which keeps the sheets temporarily bound together. Once the sheets are properly aligned to each other, they are subject to an applied pressure and high temperature, thus undergoing a curing process, which makes the assembly seal-tight. In this manner, the geometries in each of the canopy layers are aligned to each other, thus making internal passageways capable of channeling fluid.

Referring to FIGS. 3, 5, 6, 8, 9, 10, 11 and 12, a first embodiment cleaning mechanism, generally referred to as 170, is shown associated with print head 60. As described in detail herein below, cleaning mechanism 170 is adapted to clean particulate matter 165 from surface 95. More specifically, cleaning mechanism comprises a first embodiment cleaning block 175 that includes manifold body 180, canopy 185, and wiper blade 225. As shown in FIG. 9, manifold body 180 has a first passageway 220 in communication with second passageway 230, in communication with third passageway 232, in communication with fourth passageway 234, in communication with printhead surface 95.

FIG. 10 shows that manifold body 180 has a twelfth passageway 247 in communication with eleventh passageway 246, in communication with tenth passageway 245, in communication with ninth passageway 244, in communication with eighth passageway 242, in communication with seventh passageway 240, in communication with sixth passageway 238, in communication with fifth passageway 236, in communication with printhead surface 95. First passageway 220 is connected to first piping segment 260 and twelfth passageway 247 is connected to second piping segment 280 per fluidic fittings 195.

In operation of cleaning mechanism 170, a positive driving force is applied along fifth arrow 205 to suitably supply cleaning solvent via first piping segment 260 to printhead surface 95. At the same time, a predetermined vacuum is applied along sixth arrow 210 via second piping segment 280 to suitably vacuum particulate matter 165 from printhead surface 95. To ensure no unwanted spillage of solvent onto printhead surface 95, the solvent supply and removal processes are either applied simultaneously, or the solvent removal process is applied just prior to the solvent delivery process and extends just after the solvent delivery process is turned off. The fact that the solvent supply and removal processes are applied either simultaneously or close to each other means that a cleaning mechanism, such as cleaning mechanism 170, is greatly simplified.

Solvent delivering canopy 185 is oriented with respect to surface 95 such that fourth passageway 234 is alignable with surface 95 for reasons disclosed presently. In this regard, fourth passageway 234 is alignable with surface 95 for delivering a liquid solvent cleaning agent to surface 95 in order to flush particulate matter 165 from surface 95 (as shown). Of course, particulate matter 165 will be entrained in the solvent as the solvent flushes particulate matter 165 from surface 95. Moreover, first embodiment cleaning block 175 includes wiper blade 225 integrally formed therewith for lifting contaminant 165 from surface 95 as first embodiment cleaning block 175 traverses surface 95 in direction of a third arrow 227. It may be understood that canopy 185 is oriented with respect to surface 95 such that fifth passageway 236 is alignable with surface for vacuuming the solvent and entrained particulate matter 165 from surface 95 (as shown).

Figure 12A:
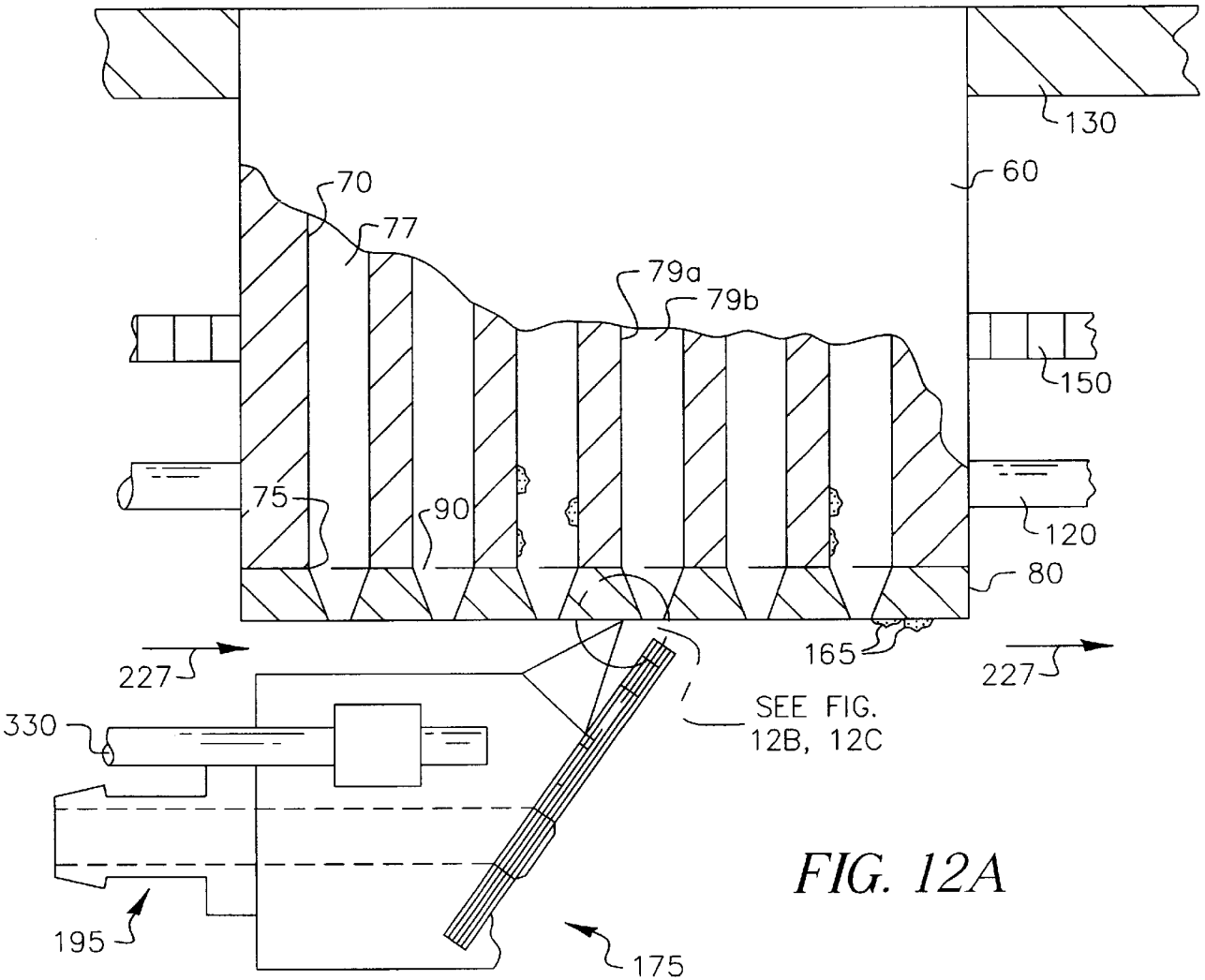
FIG. 12A is a zoomed in view in vertical section showing the positioning of the canopy relative to the wiper blade and the contact angle between wiper blade and print head.
Figure 12B:
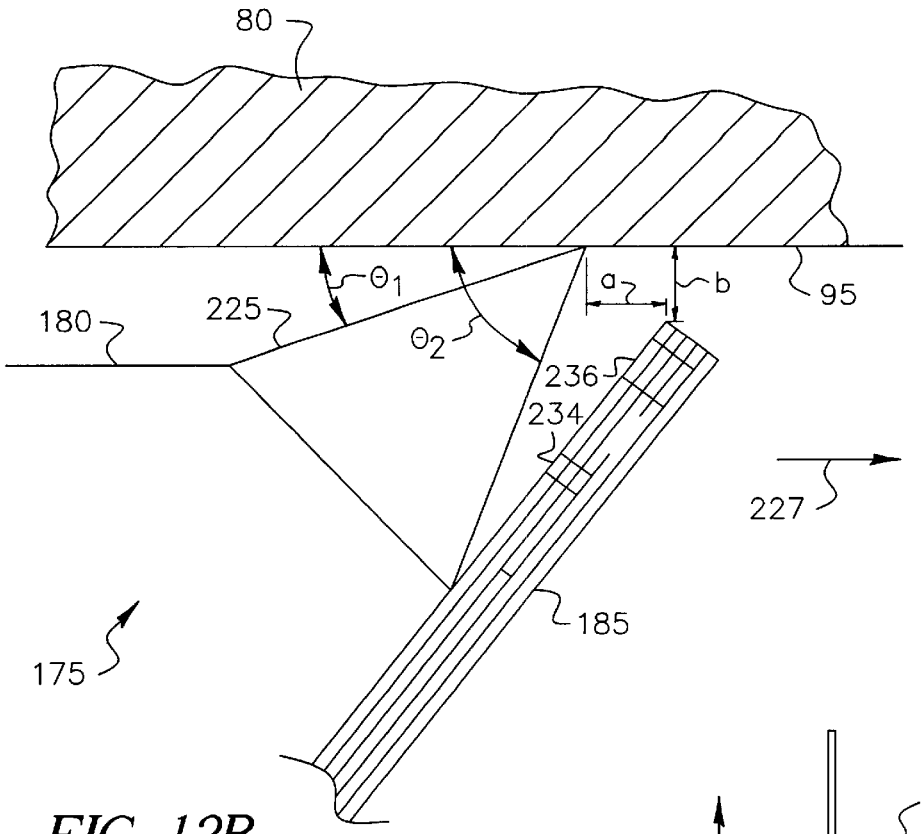
FIG. 12B is a zoomed in view in vertical section of the wiper blade interface with the printhead surface, showing the cleaning solvent circulation.

As best seen in FIGS. 12A and 12B, wiper blade 225 is defined as having contact angle $\theta_1$ of less than 90 degrees with respect to print head surface 95. Wiper blade 225 is also defined as having geometrical angle $\theta_2$ greater than $\theta_1$, but less than 90 degrees with respect to print head surface 95. Also, canopy 185 is mounted to manifold body 180 such that dimensional relationships "a" and "b" result. Dimensional relationship "a" can range from 0.010" to 0.075" and dimensional relationship "b" can range from 0.005" to 0.050". These dimensions are to be optimized based on cleaning parameters such as applied wiping force, or wiper material hardness. That is, dimensions "a" and "b" are optimized such that cleaning solvent exiting from fourth passageway 234 travels in the direction of fifth arrow 205, where it reaches the printhead surface 95.

Wiper blade 225 is in contact with surface 95 and moves in direction of third arrow 227. As wiper blade 225 traverses surface 95, it lifts contaminant 165 from surface 95. The contaminant 165 becomes entrained in the cleaning solvent. The solvent with entrained contaminant 165 is then vacuumed along sixth arrow 210 into fifth passageway 236 in alignment with printhead surface 95. These geometrical relationships result in the optimal cleaning mode when wiping in the direction of third arrow 227 and without damaging printhead surface 95.

Returning to FIGS. 3, 5, 6, 8, 9, 10 and 12, a "piping" or solvent circulation circuit, is shown and denoted generally as 250. Piping circuit 250 includes a first piping segment 260 coupled to first passageway 220 formed through manifold body 180 via fluidic fitting 195. A discharge pump 270 is connected to first piping segment 260, and discharges the solvent in the direction of fifth arrow 205. Following the solvent flow path as indicated per fifth arrows 205, the solvent is discharged through second passageway 220, through aligned second passageway 230, through aligned third passageway 232, through aligned fourth passageway 234 and ultimately onto printhead surface 95.

It may be appreciated that the solvent discharged onto surface 95 is chosen such that the solvent lubricates, at least in part, surface 95. Surface 95 is lubricated in this manner, so that previously mentioned wiper blade 225 will not substantially mar, scar, or otherwise damage surface 95 and any electrical circuitry or components that may be present on surface 95. In addition, a second piping segment 280 is coupled to twelfth passageways 247 and is also formed through manifold body 180 per fluidic fittings 195. A vacuum pump 290 is connected to second piping segment 280 for inducing negative pressure (i.e., pressure less than atmospheric pressure) in second piping segment 280. Thus, negative pressure is simultaneously induced along sixth arrows 210. As negative pressure is induced along sixth arrows 210, cleaning solvent with entrapped contaminant 165 is vacuumed from printhead surface 95, where it enters fifth passageway 236. The solvent then is transported through aligned sixth passageway 238, through aligned seventh passageway 240, through aligned eighth passageway 242, through aligned ninth passageways 244, through aligned tenth passageways 245, through aligned eleventh passageways 246, through aligned twelfth passageways 247 and finally into second piping segment 280.

Referring to FIGS. 3, 5, 7, 12, 13, 14, 15, 16, 17, 18, 20 and 21, interposed between first piping segment 260 and second piping segment 280 is a solvent supply reservoir 300 having a supply of the solvent therein. Discharge pump 270, which is connected to first piping segment 260, draws the solvent from reservoir 300 and discharges the solvent into first passageway 220 by means of second piping circuit 260. Hence, it may be appreciated that first piping circuit 260 extends from first passageway 220 to reservoir 300. In addition, vacuum pump 290, which is connected to second piping segment 280, pumps the solvent and particulate matter 165 from printhead surface 95 toward reservoir 300. Hence, it may be appreciated that second piping circuit 280 extends both from twelfth passageways 247 to reservoir 300.

Connected to second piping segment 280 and interposed between vacuum pump 290 and reservoir 300 is a filter 310 which acts to capture (i.e., separating-out) particulate matter 165 from the solvent, so that the solvent supply in reservoir 300 is free of particulate matter 165. Of course, when filter 310 becomes saturated with particulate matter 165, filter 310 is replaced by an operator of printer 10. Thus, circuit 250 defines a recirculation loop for recirculating contaminant-free solvent across surface 95 to efficiently clean surface 95. In addition, connected to first segment 260 is a first valve 314, which first valve 314 is interposed between manifold body 180 and discharge pump 270. Moreover, connected to second segment 280 is a second valve 316, which second valve 316 is interposed between filter 310 and vacuum pump 290.

The presence of first valve 314 and second valve 316 make it more convenient to perform maintenance on cleaning mechanism 170. That is, first valve 314 and second valve 316 allow cleaning mechanism 170 to be easily taken out-of service for maintenance. For example, to replace filter 310, discharge pump 270 is shut-off and first valve 314 is closed. Vacuum pump 290 is operated until solvent and particulate matter are substantially evacuated from second piping segment 280. At this point, second valve 316 is closed and vacuum pump 290 is shut-off. Next, saturated filter 310 is replaced with a clean filter 310. Thereafter, cleaning mechanism 170 is returned to service substantially in reverse to steps used to take cleaning mechanism 170 out-of service.

Referring to FIGS. 3, 5, 6, 12, 13, 14, 15, 16, 17, 18, 20 and 21, a translation mechanism, generally referred to as 320, is shown connected to first embodiment cleaning block 175 for translating first embodiment cleaning block 175 across surface 95 of print head 60. In this regard, translation mechanism 320 comprises an elongated externally threaded lead-screw 330 threadably engaging cleaning block 175. Engaging lead-screw 330 is a motor 340 capable of rotating lead-screw 330, so that first embodiment cleaning block 175 traverses surface 95 as lead-screw 330 rotates. First embodiment cleaning block 175 traverses surface 95 in direction of third arrow 227, and is also capable of reversing its direction as shown by fourth arrow 345, while either in contact with or separated from surface 95.

In addition, first embodiment cleaning block 175 is capable of being translated to any location on lead-screw 330, which preferably extends the length of guide rail 120. Being able to translate first embodiment cleaning block 175 to any location on lead-screw 330 allows first embodiment cleaning block 175 to clean print head 60 wherever print head 60 is located on guide rail 120. Moreover, connected to motor 340 is a displacement mechanism 350 for displacing first embodiment cleaning block 175 to a position in contact with surface 95 of print head 60. Displacement mechanism 350 is capable of having precise control of the contact force between wiper blade 225 and printhead surface 95 so as to provide a suitable wiping force without damaging printhead surface 95.

Referring again to FIGS. 2, 3 and 5, platen roller 40 is disposed adjacent to print head 60 and, unless appropriate steps are taken, will interfere with and displace first embodiment cleaning block 175 to a position proximate surface 95. Therefore, it is desirable to move platen roller 40 out of interference with first embodiment cleaning block 175, so that first embodiment cleaning block 175 can be displaced proximate surface 95. Therefore, according to the first embodiment of printer 10, platen roller 40 is pivoted outwardly about previously mentioned pivot shaft 57 along arc 59. After platen roller 40 has been pivoted, displacement mechanism 350 is operated to displace first embodiment cleaning block 175 to a position proximate surface 95 to begin removal of particulate matter 165 from ink channel 70 and surface 95.

Figure 11:
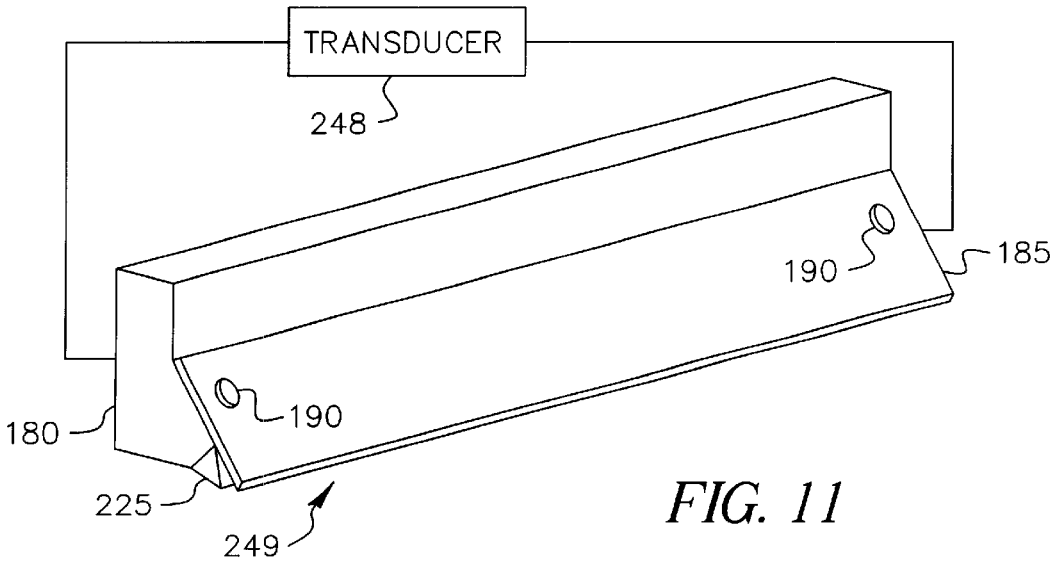
FIG. 11 is an isometric view of a second embodiment cleaning block with attached transducer.

Referring now to FIG. 11, there is shown a second embodiment cleaning block 249, which incorporates an ultrasonic transducer 248. Second embodiment cleaning block 249 is similar to first embodiment cleaning block 175, in that it also is comprised of manifold body 180, canopy 185, and wiper blade 225. In addition, second embodiment cleaning block 249 includes ultrasonic transducer 248, which is energized by an external power source (not shown). The transducer 248 is used to energize the cleaning solvent, which enhances the cleaning action of the solvent. It is obvious that second embodiment cleaning block 249 can be interchanged with first embodiment cleaning block 175, and will function in a similar fashion as first embodiment cleaning block 175.

Figure 13:
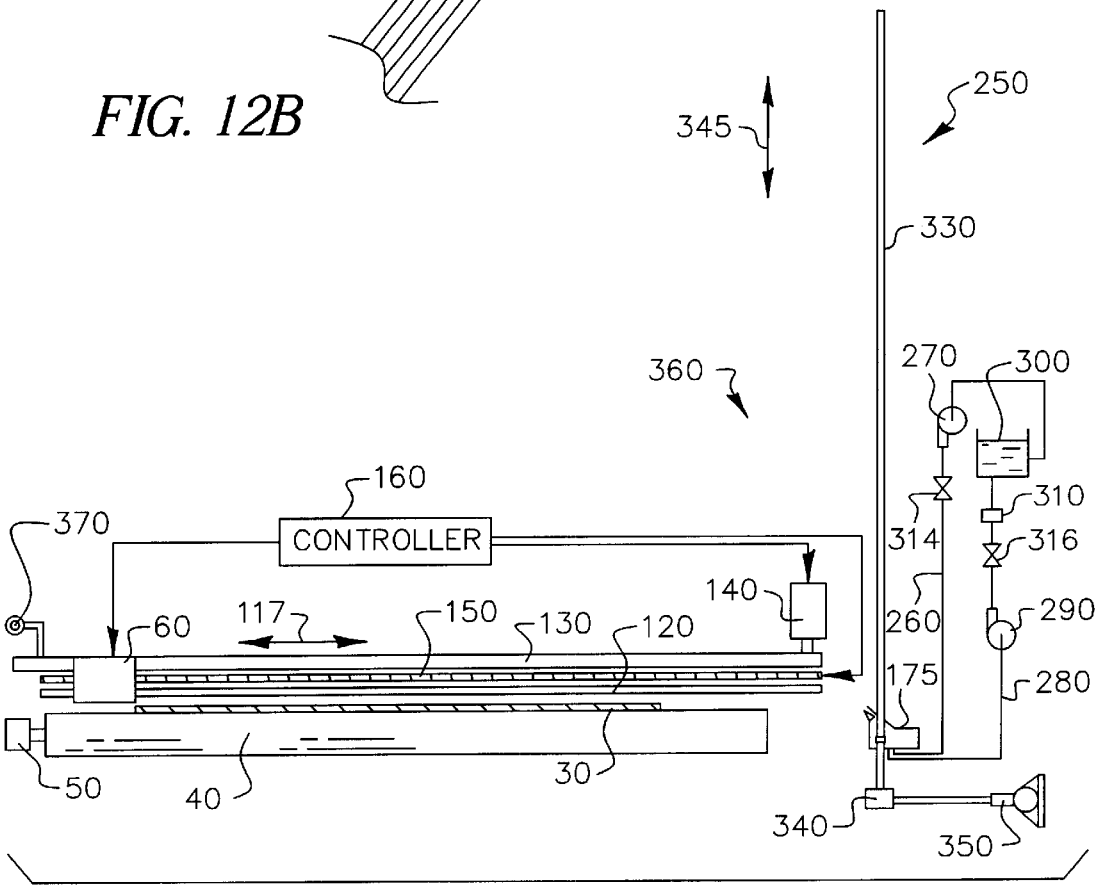
FIG. 13 is a view in elevation of a second embodiment inkjet printer, this view showing the cleaning mechanism disposed in an upright position and poised to move to a location adjacent the print head to clean the print head, which print head is capable of being pivoted into an upright position.
Figure 12C:
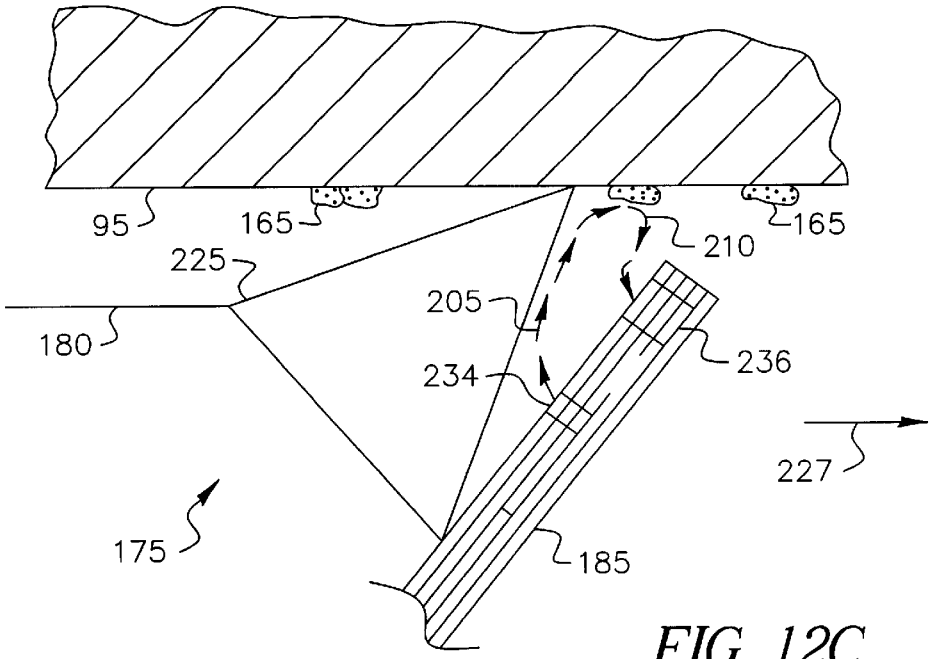
FIG. 12 is a view in vertical section of the first embodiment cleaning block while the first embodiment cleaning block cleans the print head.
Figure 14:
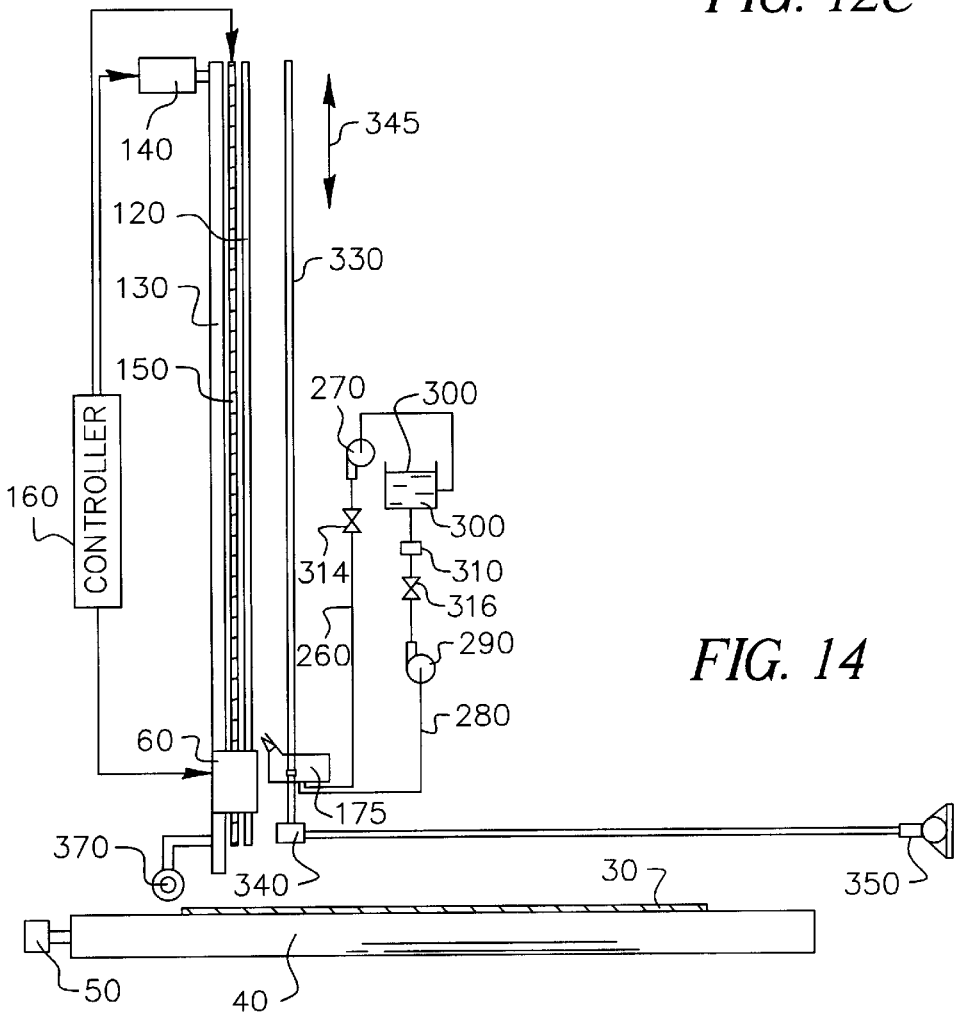
FIG. 14 is a view in elevation of the second embodiment printer, this view showing the cleaning mechanism having been moved into position to clean the print head not pivoted into an upright position.

Turning now to FIGS. 13 and 14, there is shown a second embodiment inkjet printer 360 capable of simultaneously removing particulate matter 165 from surface 95. Second embodiment ink jet printer 360 is substantially similar to first embodiment ink jet printer 10, except that platen roller 40 is fixed (i.e., non-pivoting). Also, according to this second embodiment printer, print head 60 pivots about a pivot pin 370 to an upright position (as shown). Moreover, cleaning mechanism 170 is oriented in an upright position (as shown) and displacement mechanism 350 displaces cleaning mechanism 170, so that first embodiment cleaning block 175 is moved to a location proximate surface 95.

Figure 15:
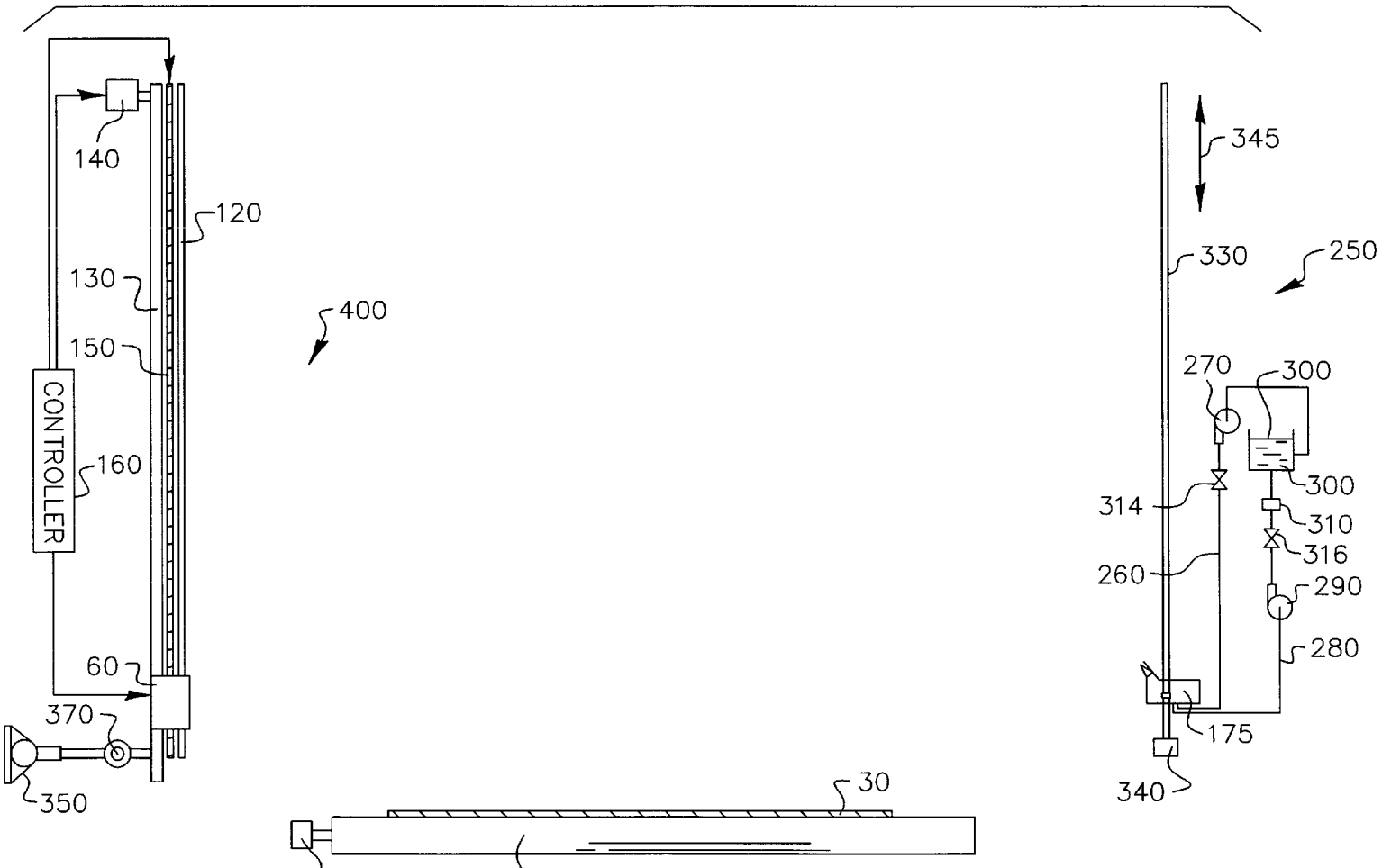
FIG. 15 is a view in elevation of a third embodiment ink jet printer, this view showing the print head pivoted into an upright position and poised to move to a location adjacent the upright cleaning mechanism to clean the print head.
Figure 16:
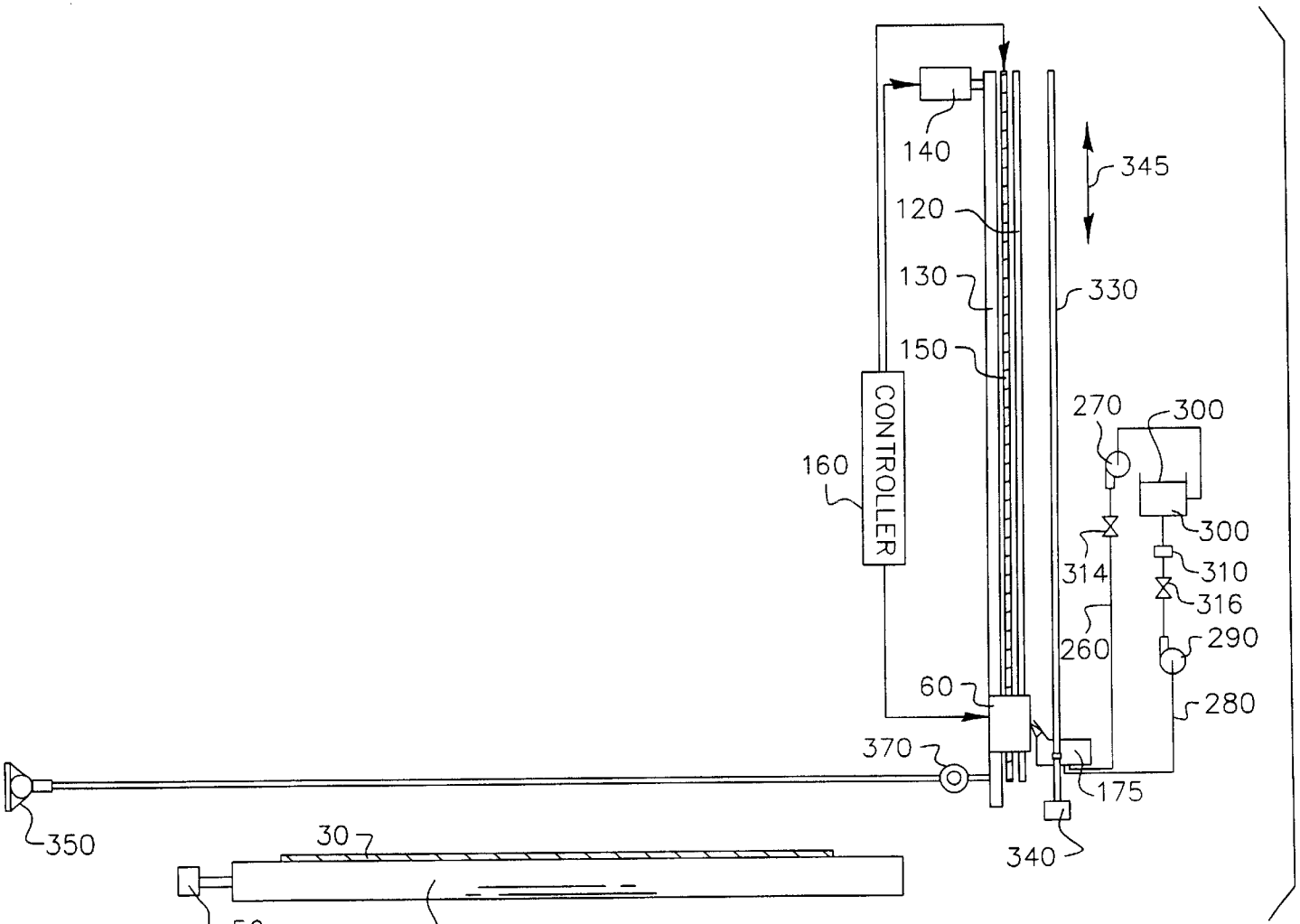
FIG. 16 is a view in elevation of the third embodiment printer, this view showing the print head having been moved into position to clean the print head.

Referring to FIGS. 15 and 16, there is shown a third embodiment ink jet printer 400 capable of simultaneously removing particulate matter 165 from surface 95. Third embodiment ink jet printer 400 is substantially similar to first embodiment ink jet printer 10, except that platen roller 40 is fixed (i.e., non-pivoting). Also, according to this third embodiment printer, print head 60 pivots about pivot pin 370 to an upright position (as shown) and displacement mechanism 350 displaces printer 400 (except for platen roller 40), so that printer 400 is moved to a location proximate cleaning mechanism 170. Moreover, cleaning mechanism 170 is oriented in a fixed upright position (as shown).

Figure 17:
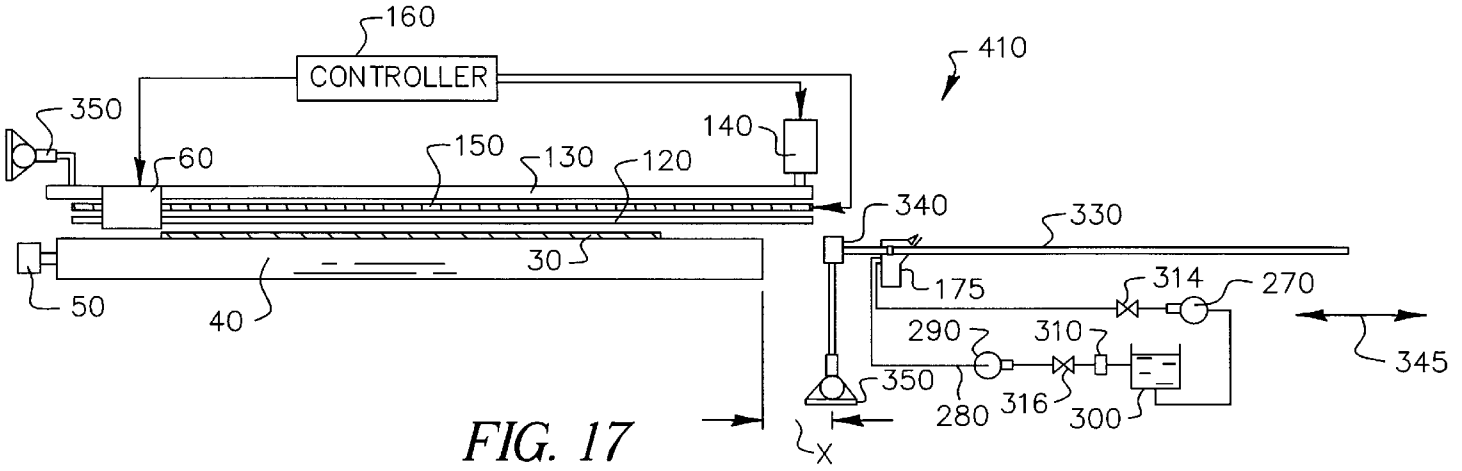
FIG. 17 is a view in elevation of a fourth embodiment ink jet printer, this view showing the print head in a horizontal position and poised to move laterally to a location adjacent the cleaning mechanism to clean the print head.
Figure 18:
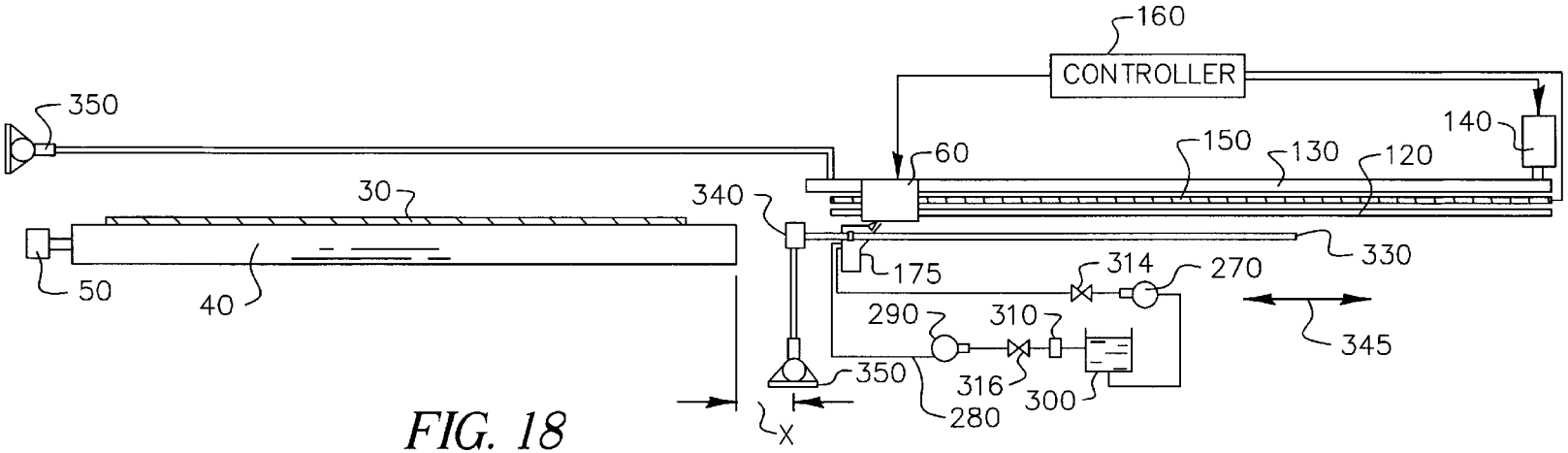
FIG. 18 is a view in elevation of the fourth embodiment printer, this view showing the print head having been moved into position to clean the print head.

Referring to FIGS. 17 and 18, there is shown a fourth embodiment ink jet printer 410 capable of removing particulate matter 165 from surface 95. Fourth embodiment ink jet printer 410 is substantially similar to first embodiment ink jet printer 10, except that platen roller 40 is fixed (i.e., non-pivoting) and cleaning assembly 170 is off-set from an end portion of platen roller 40 by a distance "X". Also, according to this third embodiment printer, displacement mechanism 350 displaces printer 410 (except for platen roller 40), so that printer 410 is moved to a location proximate cleaning mechanism 170.

Figure 19:
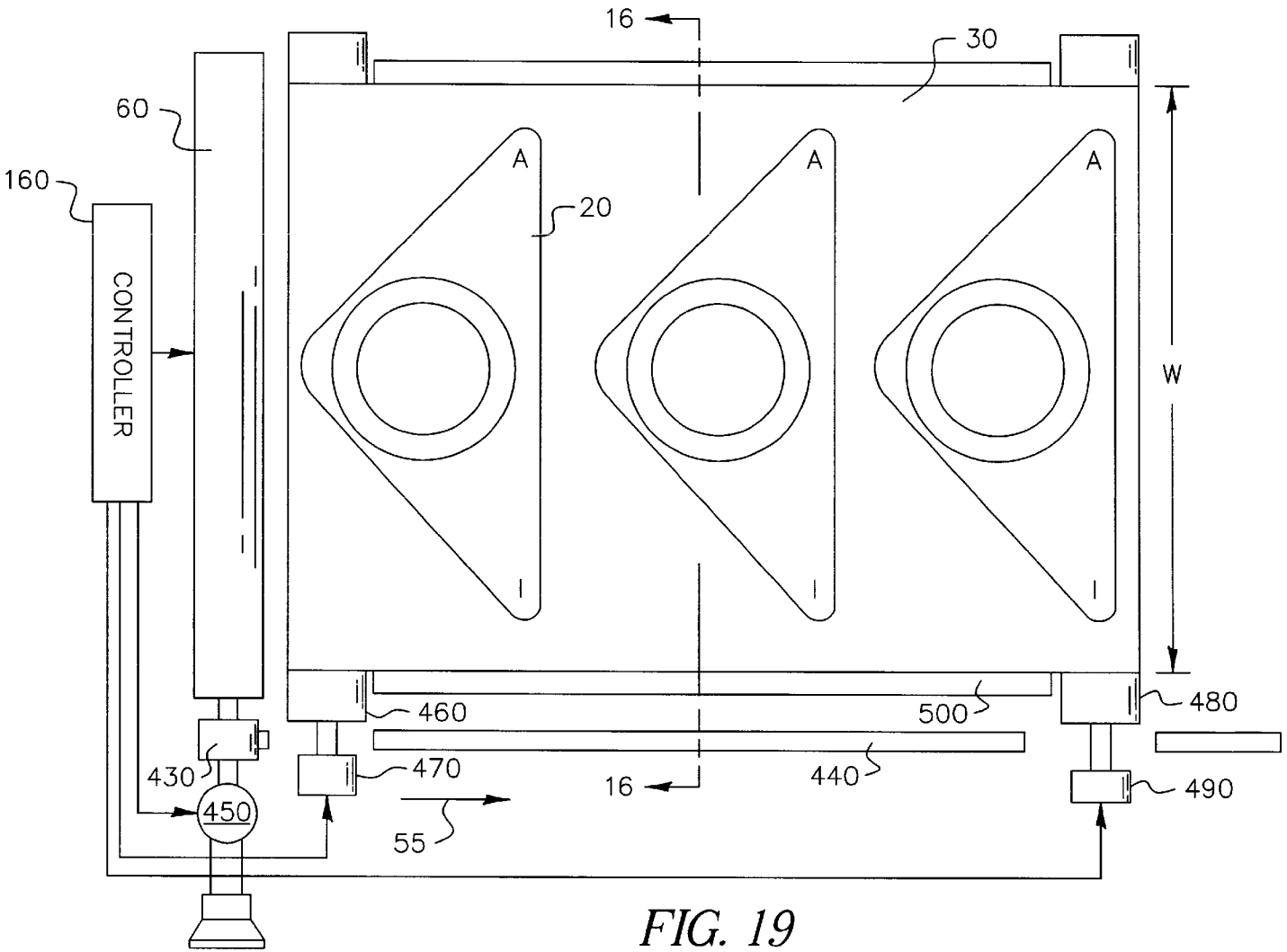
FIG. 19 is a view in plan of a fifth embodiment ink jet printer, the printer having a non-reciprocating "page-width" print head.
Figure 20:
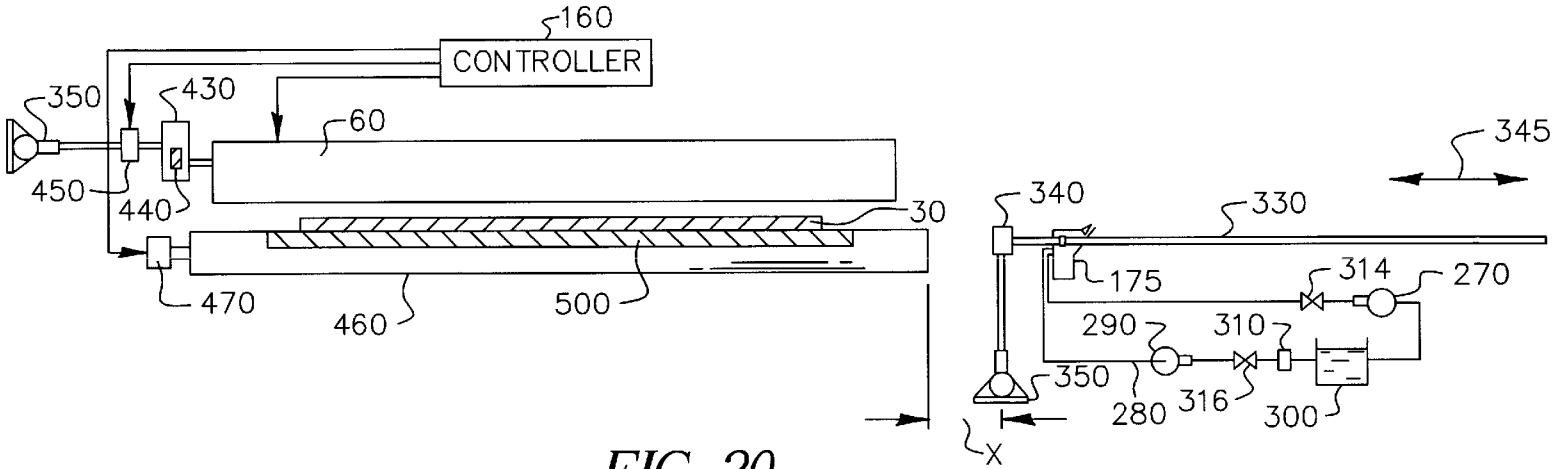
FIG. 20 is a view taken along section line 16—16 of FIG. 19, this view showing the print head in a horizontal position and poised to move laterally to a location adjacent the cleaning mechanism to clean the print head.
Figure 21:
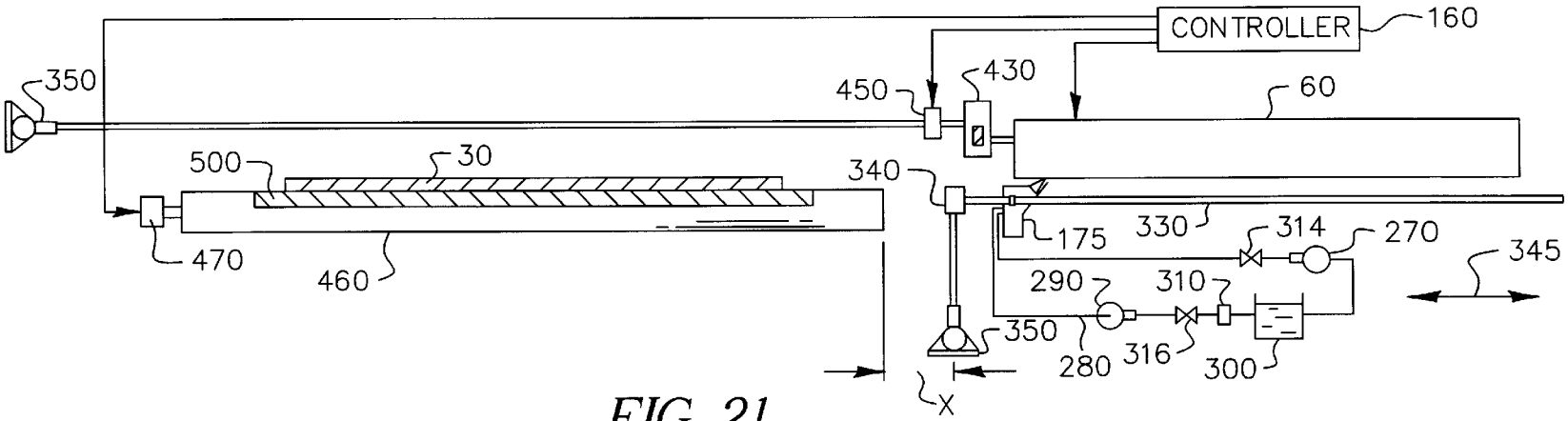
FIG. 21 is a view in elevation of the fifth embodiment printer, this view showing the print head having been moved into position to clean the print head.

Referring to FIGS. 19, 20 and 21, there is shown a fifth embodiment ink jet printer, generally referred to as 420, for printing image 20 on receiver 30. Fifth embodiment printer 420 is a so-called "page-width" printer capable of printing across width W of receiver 30 without reciprocating across width W. That is, printer 420 comprises print head 60 of length substantially equal to width W. Connected to print head 60 is a carriage 430 adapted to carry print head 60 in direction of first arrow 55. In this regard, carriage 430 slidably engages an elongate slide member 440 extending parallel to receiver 30 in direction of first arrow 55. A print head drive motor 450 is connected to carriage 430 for operating carriage 430, so that carriage 430 slides along slide member 440 in direction of first arrow 55. As carriage 430 slides along slide member 440 in direction of first arrow 55, print head 60 also travels in direction of first arrow 55 because print head 60 is connected to carriage 430. In this manner, print head 60 is capable of printing a plurality of images 20 (as shown) in a single printing pass along length of receiver 30.

In addition, a first feed roller 460 engages receiver 30 for feeding receiver 30 in direction of first arrow 55 after all images 20 have been printed. In this regard, a first feed roller motor 470 engages first feed roller 460 for rotating first feed roller 460, so that receiver 30 feeds in direction of first arrow 55. Further, a second feed roller 480, spaced-apart from first feed roller 460, may also engage receiver 30 for feeding receiver 30 in direction of first arrow 55. In this case, a second feed roller motor 490, synchronized with first feed roller motor 470, engages second feed roller 480 for rotating second feed roller 480, so that receiver 30 smoothly feeds in direction of first arrow 55. Interposed between first feed roller 460 and second feed roller 480 is a support member, such as a stationary flat platen 500, for supporting receiver 30 thereon as receiver feeds from first feed roller 460 to second feed roller 480. Of course, previously mentioned controller 160 is connected to print head 60, print head drive motor 450, first feed roller motor 470 and second feed roller motor 490 for controlling operation thereof in order to suitably form images 20 on receiver 30.

Still referring to FIGS. 19, 20 and 21, according to this fifth embodiment printer 420, displacement mechanism 350 displaces printer 420 (except for feed rollers 460/480 and platen 500), so that printer 420 is moved to a location proximate cleaning mechanism 170.

The solvent cleaning agent mentioned hereinabove may be any suitable liquid solvent composition, such as water, isopropanol, diethylene glycol, diethylene glycol monobutyl ether, octane, acids and bases, surfactant solutions and any combination thereof. Complex liquid compositions may also be used, such as microemulsions, micellar surfactant solutions, vesicles and solid particles dispersed in the liquid.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, with respect to the second embodiment printer 360, displacement mechanism 350 may be foldable to the upright position from a substantially horizontal position. This configuration of the invention will minimize the external envelope of printer 360 when print head 60 is not being cleaned by cleaning mechanism 170, so that printer 360 can be located in a confined space with limited headroom.

Therefore, what is provided is an ink jet printer with cleaning mechanism using a laminated polyimide structure, and method of assembling same, which cleaning mechanism is capable of cleaning the print head surface.

PARTS LIST

10 . . . first embodiment ink jet printer
20 . . . image
30 . . . receiver
40 . . . platen roller
50 . . . platen roller motor
55 . . . first arrow
57 . . . pivot shaft
59 . . . arc
60 . . . print head
70 . . . ink channel
75 . . . ink channel outlet
77 . . . ink body
79*a* . . . side wall
79*b* . . . side wall
80 . . . cover plate
90 . . . orifice
95 . . . surface
100 . . . ink droplet
105 . . . preferred axis of ink droplet ejection
110 . . . transport mechanism
115*a* . . . first position (of print head)
115*b* . . . second position (of print head)
117 . . . second arrow
120 . . . guide rail
130 . . . drive belt
140 . . . drive belt motor
150 . . . encoder strip
160 . . . controller
165 . . . particulate matter
167 . . . non-preferred axis of ink droplet ejection
170 . . . cleaning mechanism
175 . . . first embodiment cleaning block
180 . . . manifold body
185 . . . canopy
185*a* . . . first canopy layer
185*b* . . . second canopy layer
185*c* . . . third canopy layer
185*d* . . . fourth canopy layer
185*e* . . . fifth canopy layer
187 . . . alignment holes
190 . . . alignment pins
195 . . . fluidic fittings
205 . . . fifth arrow
210 . . . sixth arrow
220 . . . first passageway
225 . . . wiper blade
227 . . . third arrow
230 . . . second passageway
232 . . . third passageway
234 . . . fourth passageway
236 . . . fifth passageway
238 . . . sixth passageway
240 . . . seventh passageway
242 . . . eighth passageway
244 . . . ninth passageway
245 . . . tenth passageway
246 . . . eleventh passageway
247 . . . twelfth passageway
248 . . . transducer
249 . . . second embodiment cleaning block
250 . . . piping circuit
260 . . . first piping segment
270 . . . discharge pump
280 . . . second piping segment
290 . . . vacuum pump
300 . . . reservoir
310 . . . filter
314 . . . first valve
316 . . . second valve
320 . . . translation mechanism
330 . . . lead-screw
340 . . . motor
345 . . . fourth arrow
350 . . . displacement mechanism
360 . . . second embodiment ink jet printer
370 . . . pivot pin
400 . . . third embodiment ink jet printer
410 . . . fourth embodiment ink jet printer
420 . . . fifth embodiment ink jet printer
430 . . . carriage
440 . . . slide member
450 . . . print head drive motor
460 . . . first feed roller
470 . . . first feed roller motor
480 . . . second feed roller
490 . . . second feed roller motor
500 . . . stationary platen

What is claimed is:

1. A self cleaning ink jet printer comprising:

a print head having a surface thereon and an ink channel therein; and a cleaning mechanism associated with said print head and adapted to clean contaminant from the surface, said cleaning mechanism including a canopy structure for delivering solvent to said surface and removing it and contaminants from said surface after cleaning and wherein said canopy structure comprises a plurality of canopy layers.

2. The printer of claim 1, wherein said canopy layers are comprised of alternating thin polyimide and stainless steel sheets.

3. The printer of claim 1, wherein said canopy layers are comprised of three polyimide sheets with two stainless steel sheets interspersed between said three polyimide sheets.

4. The printer of claim 3, wherein said polyimide sheets and stainless steel sheets each range between 0.001 and 0.010 inches in thickness.

5. The printer of claim 1, wherein said canopy layers include a plurality of internal passageways for channeling fluid.

6. The printer of claim 5, further comprising:

a manifold coupled to said canopy structure and including internal passageways for directing fluid through said internal passageways of said canopy layers; and a piping circuit adapted for circulating a cleaning agent through said manifold via said internal passageways.

7. The printer of claim 6, wherein said piping circuit further comprises:

a solvent supply reservoir;

discharge means coupled to said supply reservoir and adapted for directing solvent from said reservoir to said canopy structure via a first opening of said manifold; and vacuum means for creating a negative pressure that causes said cleaning solvent to exit said canopy structure via a second opening of said manifold.

8. The printer of claim 7, further comprising a filter interspersed between said vacuum means and said reservoir for capturing particulate matter.

9. The ink jet printer of claim 6 wherein said canopy layers are comprised of sheets each being in a thickness range between 0.001 and 0.010 inches in thickness.

10. The ink jet printer of claim 9 wherein said canopy layers are comprised of polyimide sheets and stainless steel sheets that are interspersed between said polyimide sheets.

11. The ink jet printer of claim 5 wherein said canopy layers are comprised of sheets each being in a thickness range between 0.001 and 0.010 inches in thickness.

12. The ink jet printer of claim 11 wherein said canopy layers are comprised of polyimide sheets and stainless steel sheets that are interspersed between said polyimide sheets.

13. The printer of claim 1, further comprising a wiper blade attached to said canopy structure.

14. The ink jet printer of claim 13 wherein said canopy layers are comprised of sheets each being in a thickness range between 0.001 and 0.010 inches in thickness.

15. The ink jet printer of claim 14 wherein said canopy layers are comprised of polyimide sheets and stainless steel sheets that are interspersed between said polyimide sheets.

16. A self-cleaning ink jet printer, comprising:

a print head having a surface thereon surrounding an orifice in communication with an ink channel formed in said print head;

a cleaning block alignable with the surface for delivering a cleaning agent to the surface and removing contaminant from the surface, said cleaning block having a first passageway for delivering a cleaning agent to said surface and a second passageway for vacuuming the cleaning agent and contaminant from the surface, wherein said cleaning block further comprises:

(a) a canopy body;

(b) a canopy coupled to said canopy body; and (c) a manifold coupled to said canopy body and having internal fluid channels for directing a cleaning agent through said canopy; and (d) a wiper blade extending opposite said canopy and adapted for coming into contact with said surface for cleaning contaminant therefrom; and cleaning agent circulation circuit connected to said cleaning block for circulating the cleaning agent through said cleaning block, said circulation circuit including a discharge pump coupled to said first passageway for delivering a cleaning agent to said cleaning block and a vacuum pump coupled to said second passageway for inducing negative pressure in the first passageway, whereby contaminant is vacuumed from the surface.

17. The printer of claim 16, further comprising:

a platen associated with said print head for supporting a receiver to be printed on by said print head; and a pivot shaft connected to said platen for pivoting said platen about said pivot shaft.

18. The printer of claim 16, further comprising a translation mechanism connected to said cleaning block for translating said cleaning block across said print head.

19. The ink jet printer of claim 16 wherein said canopy is comprised of a plurality of canopy layers and wherein said canopy layers are comprised of sheets each being in a thickness range between 0.001 and 0.010 inches in thickness.

20. The ink jet printer of claim 19, wherein said canopy layers are comprised of polyimide sheets and stainless steel sheets that are interspersed between said polyimide sheets.

21. A self-cleaning ink jet printer, comprising:

a print head having a surface thereon surrounding an orifice in communication with an ink channel formed in said print head;

a cleaning block alignable with the surface for delivering a cleaning agent to the surface and removing contaminant from the surface, said cleaning block having a first passageway for delivering a cleaning agent to said surface and a second passageway for vacuuming the cleaning agent and contaminant from the surface; and a cleaning agent circulation circuit connected to said cleaning block for circulating the cleaning agent through said cleaning block, said circulation circuit including a discharge pump coupled to said first passageway for delivering a cleaning agent to said cleaning block and a vacuum pump coupled to said second passageway for inducing negative pressure in the first passageway, whereby contaminant is vacuumed from the surface; and further comprising a displacement mechanism connected to said cleaning block for displacing said cleaning block to a position proximate the surface of said print head.

22. The ink jet printer of claim 21 wherein said cleaning block includes a canopy having fluid channels formed therein for delivering and removing cleaning solution to and from the surface and the canopy is comprised of a plurality of canopy layers and wherein said canopy layers are comprised of sheets each being in a thickness range between 0.001 and 0.010 inches in thickness.

23. The ink jet printer of claim 22 wherein said canopy layers are comprised of polyimide sheets and stainless steel sheets that are interspersed between said polyimide sheets.

24. A self-cleaning ink jet printer, comprising:

a print head having a surface thereon surrounding an orifice in communication with an ink channel formed in said print head;

a cleaning block alignable with the surface for delivering a cleaning agent to the surface and removing contaminant from the surface, said cleaning block having a first passageway for delivering a cleaning agent to said surface and a second passageway for vacuuming the cleaning agent and contaminant from the surface; and a cleaning agent circulation circuit connected to said cleaning block for circulating the cleaning agent through said cleaning block, said circulation circuit including a discharge pump coupled to said first passageway for delivering a cleaning agent to said cleaning block and a vacuum pump coupled to said second passageway for inducing negative pressure in the first passageway, whereby contaminant is vacuumed from the surface; and further comprising a displacement mechanism connected to said print head for displacing said print head to a position proximate said cleaning block.

25. A self-cleaning ink jet printer, comprising:

a print head having a surface thereon surrounding a plurality of ink ejection orifices in communication with respective ones of a plurality of ink channels formed in said print head;

a cleaning block associated with said surface of said print head for cleaning said surface, said cleaning block comprising:

(a) a manifold body having separate internal passageways allowing for solvent flow;

(b) a canopy having a first internal passageway for delivering a cleaning agent to said surface, and a second passageway for removing both cleaning agent and particulate matter found on the surface; and (c) a wiper blade to loosen contaminant from printhead surface;

a piping circuit coupled with said cleaning block, said piping circuit comprising:

(a) a first piping segment coupled to the first passageway for transporting a cleaning solvent from a discharge pump to said first passageway;

(b) the discharge pump being connected to said first piping segment for discharging the solvent into the first piping segment, whereby the solvent discharges into the first passageway while the discharge pump discharges the solvent into the first piping segment;

(c) a second piping segment coupled to the second passageway for removing cleaning solvent with entrained particulate, whereby particulate matter residing on the surface is entrained in the solvent and removed from the surface due to the action of the wiper blade, canopy structure and piping circuit.

26. The printer of claim 25, further comprising:

a platen associated with said print head for supporting a receiver to be printed on by said print head; and a pivot shaft connected to said platen for pivoting said platen about said pivot shaft.

27. The printer of claim 25, further comprising a translation mechanism connected to said cleaning block for translating said cleaning block across the surface of said print head.

28. The printer of claim 27, wherein said translation mechanism comprises a lead-screw threadably engaging said cleaning block.

29. The printer of claim 25, further comprising a displacement mechanism connected to said cleaning block for displacing said cleaning block into engagement with the surface of said print head.

30. The printer of claim 25, further comprising a displacement mechanism connected to said print head for displacing said print head into contact with said cleaning block.

31. The printer of claim 25, wherein said piping circuit comprises a solvent supply reservoir connected to said discharge pump for supplying the solvent to said discharge pump.

32. The printer of claim 25, wherein said piping circuit comprises a filter coupled to a vacuum pump for capturing contaminant vacuumed from the surface by said vacuum pump.

33. The ink jet printer of claim 25 wherein said canopy has fluid channels formed therein for delivering and removing cleaning solution to and from the surface and the canopy is comprised of a plurality of canopy layers and wherein said canopy layers are comprised of sheets each being in a thickness range between 0.001 and 0.010 inches in thickness.

34. The ink jet printer of claim 33 wherein said canopy layers are comprised of polyimide sheets and stainless steel sheets that are interspersed between said polyimide sheets.

35. A cleaning mechanism for cleaning an ink jet print head having a surface having contaminant thereon and an ink channel having contaminant therein, the ink channel terminating in an orifice on the surface, comprising:

a manifold body having separate internal passageways allowing for solvent flow;

a canopy structure coupled to said manifold body and adapted for receiving a solvent through said internal passageways of said manifold body, said canopy structure further adapted to direct solvent to said surface; and a wiper blade capable of making contact with said surface so that contaminants are loosened from said surface.

36. The cleaning mechanism of claim 35, wherein said canopy structure further comprises a plurality of alternating polyimide and stainless steel sheets.

37. The cleaning mechanism of claim 36, further comprising a plurality of internal fluidic passageways within said polyimide and stainless steel sheets.

38. The cleaning mechanism of claim 36, wherein said polyimide and stainless steel sheets range in thickness from between 0.001 and 0.010-inch thick.

39. The cleaning mechanism of claim 35 wherein said canopy structure comprises a plurality of layers which include internal fluidic passageways and wherein said layers are each from between 0.001 and 0.010 inches in thickness.

40. The ink jet printer of claim 39 wherein said canopy layers are comprised of polyimide sheets and stainless steel sheets that are interspersed between said polyimide sheets.

41. A method of cleaning the surface of an ink jet printhead comprising the steps of:

providing a cleaning block with a wiper blade and canopy structure and traversing the cleaning block about the printhead so that the wiper blade makes contact with the surface to an extent to scrape contaminant from the surface;

circulating a cleaning agent through said cleaning block while said wiper blade makes contact with said surface; and contaminants from said surface are loosened and captured by said canopy structure as they are scraped off the surface by said wiper blade;

wherein said circulating step is performed by the steps of:

discharging said cleaning agent through said cleaning block in a first direction; and applying a vacuum pressure to said cleaning block to cause said cleaning agent to flow in a second direction.

42. The method of claim 41, wherein said traversing step is performed by moving said printhead to a predefined cleaning position.

43. The method of claim 41 wherein said canopy structure is formed of a plurality of layers which include internal fluidic passageways through which cleaning fluid is circulated, the layers being from between 0.001 and 0.010 inches in thickness.

44. A method of cleaning the surface of an ink jet printhead comprising the steps of:

providing a cleaning block with a wiper blade and canopy structure and traversing the cleaning block about the printhead so that the wiper blade makes contact with the surface to an extent to scrape contaminant from the surface;

circulating a cleaning agent through said cleaning block while said wiper blade makes contact with said surface; and contaminants from said surface are loosened and captured by said canopy structure as they are scraped off the surface by said wiper blade, wherein cleaning agent is discharged to said surface and vacuumed from said surface simultaneously.

45. The method of claim 44 wherein said canopy structure has a plurality of layers which include internal fluidic passageways through which cleaning fluid is circulated, the layers being formed from between 0.001 and 0.010 inches in thickness.

* * * * *